US007381194B2

(12) United States Patent
Yoda et al.

(10) Patent No.: US 7,381,194 B2
(45) Date of Patent: Jun. 3, 2008

(54) MASSAGE CHAIR

(75) Inventors: Yuki Yoda, Kusatsu (JP); Daisuke Tsukada, Hikone (JP); Shinji Tsutsui, Hikone (JP); Takayoshi Tanizawa, Notogawacho (JP); Masamichi Miyaguchi, Hikone (JP); Junji Nakamura, Hikone (JP); Yousuke Kurata, Hikone (JP); Motoharu Muto, Osaka (JP); Takeo Iljima, Hikone (JP)

(73) Assignee: Matsushita Electric Works, Ltd., Osaka (JP)

( * ) Notice: Subject to any disclaimer, the term of this patent is extended or adjusted under 35 U.S.C. 154(b) by 506 days.

(21) Appl. No.: 11/014,033

(22) Filed: Dec. 17, 2004

(65) Prior Publication Data

US 2005/0146176 A1 Jul. 7, 2005

(30) Foreign Application Priority Data

Dec. 22, 2003 (JP) ..... 2003-425046
Dec. 22, 2003 (JP) ..... 2003-425047
Dec. 22, 2003 (JP) ..... 2003-425100

(51) Int. Cl.
*A61H 7/00* (2006.01)
*A61H 19/00* (2006.01)

(52) U.S. Cl. ..... 601/133; 601/84; 601/86; 601/151

(58) Field of Classification Search ..... 601/46, 601/49–51, 53, 84–93, 97, 98, 101, 61, 63–65, 601/103, 115, 133, 148.152
See application file for complete search history.

(56) References Cited

U.S. PATENT DOCUMENTS 3,483,862 A 12/1969 Takeuchi
6,491,652 B1 12/2002 Hata et al.
2006/0142676 A1* 6/2006 Fujii et al. ..... 601/98

FOREIGN PATENT DOCUMENTS

JP 10-243981 * 9/1998

(Continued)

OTHER PUBLICATIONS

English language Abstract of JP 2003-153970.

(Continued)

*Primary Examiner*—Justine R. Yu
*Assistant Examiner*—Kristen C. Matter
(74) *Attorney, Agent, or Firm*—Greenblum & Bernstein, P.L.C.

(57) ABSTRACT

A massage chair has a seating surface, a backrest and armrests at the opposite left and right sides. A covering member vertically displaceable to be opened and closed is provided on the upper surface of an armrest main body of each armrest. A massaging device is provided on at least either one of the lower surface of each covering member and the upper surface of the corresponding armrest main body. The massaging devices are driven with hands and arms tightly held between the lower surfaces of the covering members and the upper surfaces of the armrest main bodies, and the upper surfaces of the covering member serve as arm resting surfaces with the covering members closed and the massaging means not driven. There can be provided a massage chair whose arm resting positions are not restricted when the massage chair is not used to massage the hands and arms.

18 Claims, 33 Drawing Sheets

FOREIGN PATENT DOCUMENTS

| | | | |
|---|---|---|---|
| JP | 2003-153970 | | 5/2003 |
| JP | 2003-108774 | * | 7/2003 |
| JP | 2003-180773 | | 7/2003 |
| JP | 2003-180774 | | 7/2003 |
| JP | 2003-310683 | * | 11/2003 |
| JP | 2003-325624 | * | 11/2003 |
| WO | 01/00132 | | 1/2001 |

OTHER PUBLICATIONS

English language Abstract of JP2003-180773.
English language Abstract of JP2003-180774.

* cited by examiner

MASSAGE CHAIR

BACKGROUND OF THE INVENTION

The present invention relates to a massage chair which is provided with a device for massaging hands and arms of a user on armrests.

Massage chairs provided with a seating surface, a backrest and armrests and having a device for massaging hands and arms of a user provided on the armrests have been widely known (for example, see Japanese Unexamined Patent Publication Nos. 2003-180773, 2003-180774 and 2003-153970).

Japanese Unexamined Patent Publication No. 2003-180773 discloses armrests having standing walls provided on the opposite sides of each armrest along the widthwise direction of the arms and capable of massaging the hands and arms of a human body through the expansion of air bags by means of compressed air. Japanese Unexamined Patent Publication No. 2003-180774 discloses armrests having a standing wall formed at one side of each armrest along the widthwise direction of the arms and having an arcuate cross section, and capable of massaging the hand and arm of a human body through the expansion of air bags by means of compressed air. Further, Japanese Unexamined Patent Publication No. 2003-153970 discloses armrests having a standing wall provided at one side of each armrest along the widthwise direction of the arms and capable of massaging the hands and arms of a human body through the expansion of air bags by means of compressed air.

A problem residing in the prior art is that the standing wall(s) is/are provided at one or both sides of each armrest and the user feels tight and cannot relax because the user can place his/her arms on restricted positions of the armrests even when he/she does not use an arm massaging function. Further, since the massage is given by the standing walls defining grooves having a fixed width, the massage feeling differs depending on the thickness of the user's arms. Further, the massage feeling is soft because the hands and arms are massaged by surfaces and some users may feel unsatisfied. Furthermore, since the massage is given by the standing walls at the opposite sides, the massage feeling from the upper side of the arms is weak.

SUMMARY OF THE INVENTION

It is an object of the present invention to provide a massage chair which is free from the problems residing in the prior art.

According to an aspect of the present invention, a massage chair includes a seating surface, a backrest, and armrests at opposite left and right sides. The massage chair is provided with a covering member on an upper surface of an armrest main body of each armrest and vertically displaceable to be opened and closed, and a massaging device on at least either one of the lower surface of each covering member and the upper surface of the corresponding armrest main body.

The massaging device is driven with a hand and an arm held between the lower surface of the covering member and the upper surface of the armrest main body. The upper surface of the covering member serves as an arm resting surface with the covering member closed and the massaging device not driven.

This massaging chair can give a desired stimulation or massaging to a hand or an arm without restricting the arm resting position.

These and other objects, features, aspects, and advantages of the present invention will become more apparent from the following detailed description of the preferred embodiments/examples with reference to the accompanying drawings.

DETAILED DESCRIPTION OF THE PREFERRED EMBODIMENTS OF THE INVENTION

Figure 1:
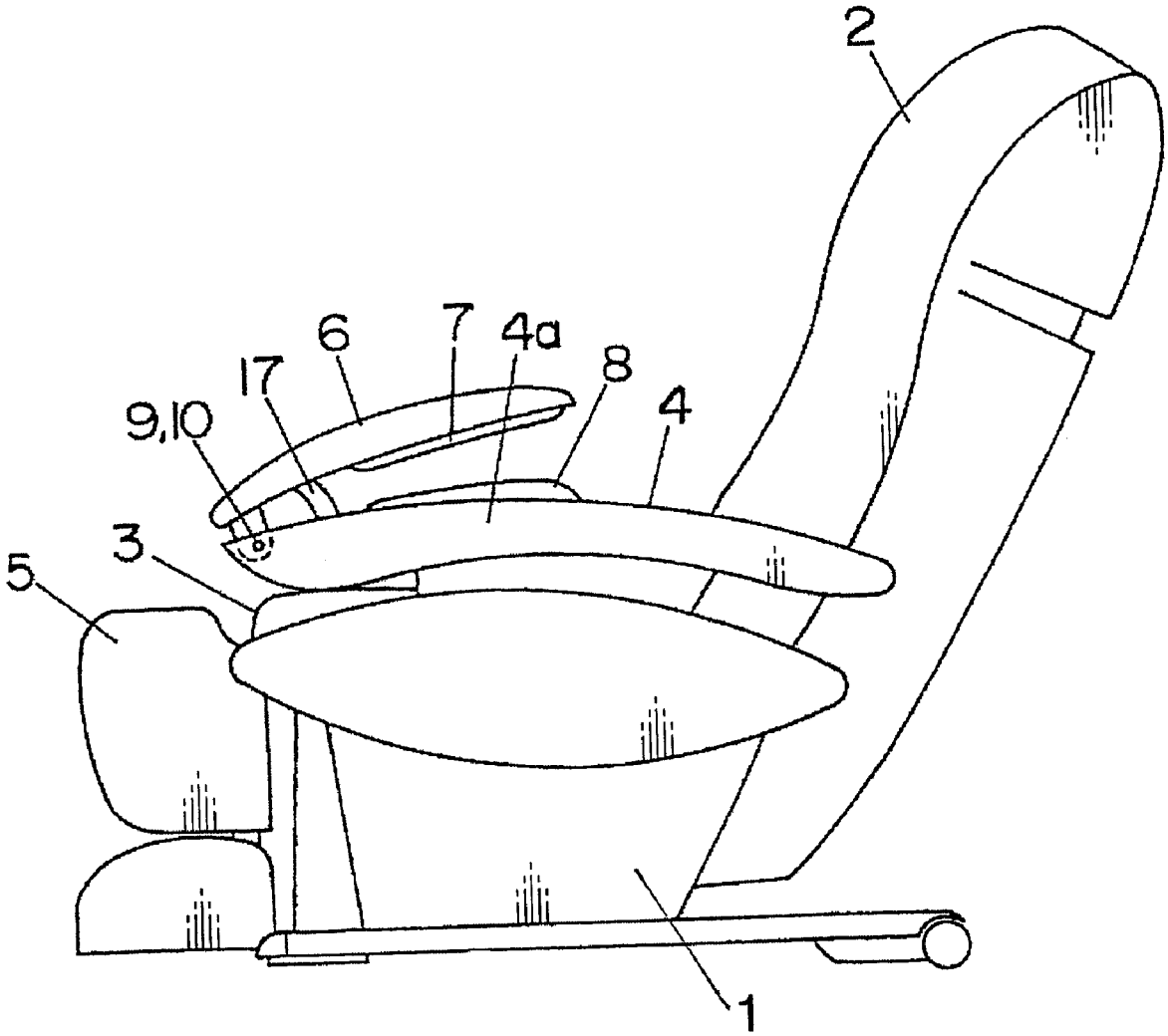
FIG. 1 is a side view of a massage chair according to an embodiment of the invention.

As shown in FIG. 1, a massage chair 1 embodying the present invention is mainly comprised of a backrest 2, a seating surface 3, armrests 4 at the opposite left and right sides, and an ottoman 5, and covering members 6 vertically rotatable to be closed and opened are provided on the upper surfaces of armrest main bodies 4*a* of the armrests 4. The upper surfaces of the covering members 6 are moderately curved surfaces substantially in parallel with the upper surfaces of the armrest main bodies 4*a* and normally serve as arm resting surfaces.

Massaging devices 7, 8 are provided on the lower surface of each covering member 6 and the upper surface of each armrest main body 4*a*. These massage devices 7, 8 are expandable and shrinkable air bags in this embodiment, and air is supplied thereto from a compressed air supplier 23 by way of air supplying pipes 21, 22. Although the massaging devices 7, 8 are the air bags for pressing a human body by expanding upon receiving the compressed air in this embodiment, treatment members may be caused to project and retract to press a human body for the massage.

Figure 2:
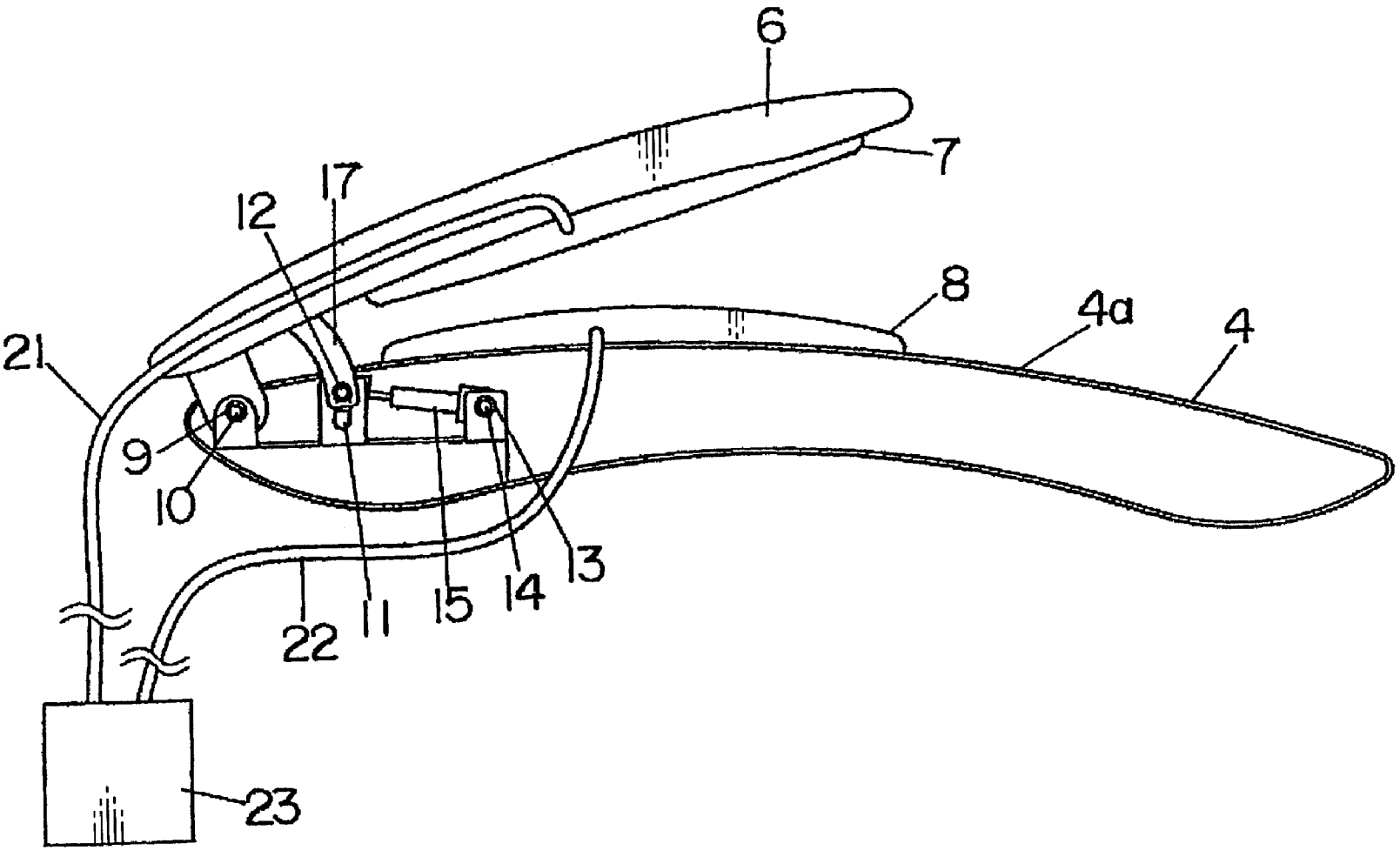
FIG. 2 is a side view partly in section enlargedly showing an armrest section of the massage chair with a covering member opened.
Figure 3:
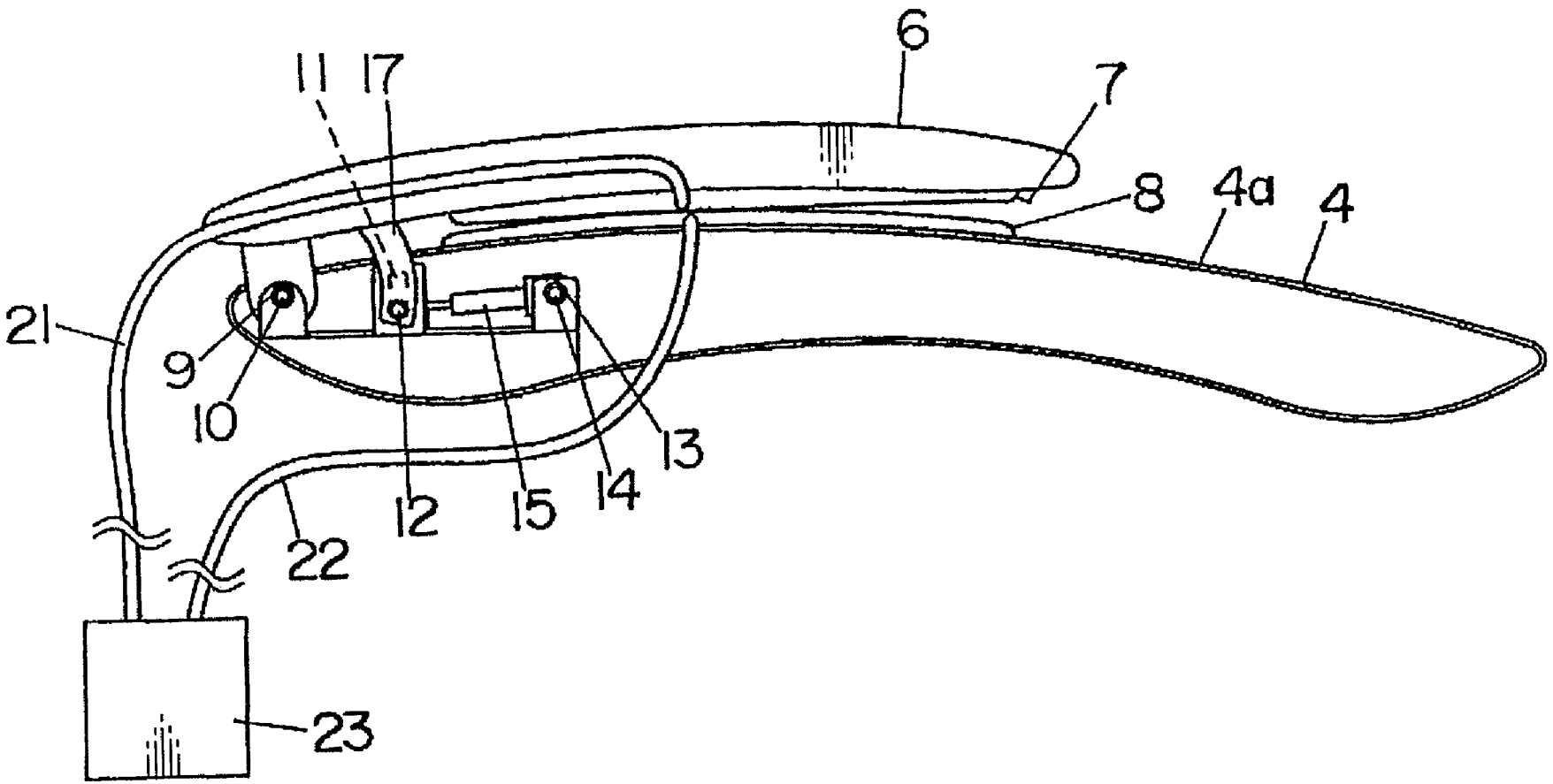
FIG. 3 is a side view partly in section enlargedly showing the arrest section of the massage chair with the covering member closed.

In the embodiment shown in FIGS. 1 to 3, each covering member 6 is rotatably supported by a pin 10 about a supporting point 9 located at the front side of the armrest main body 4*a* and a rear part thereof is vertically displaced about a front side thereof to open and close the covering element 6.

Figure 4:
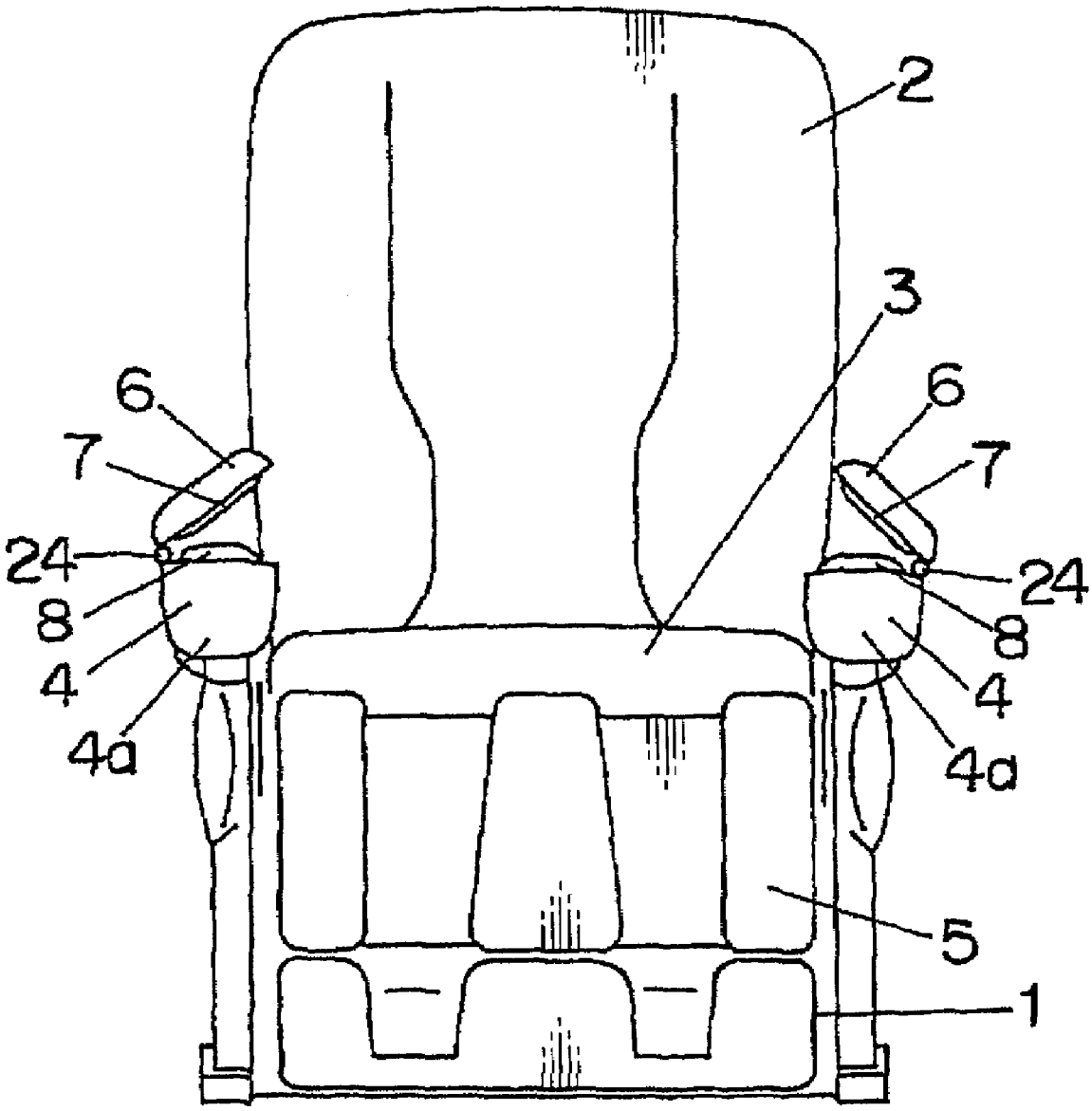
FIG. 4 is a front view of a massage chair according to a first modification of the embodiment.
Figure 5:
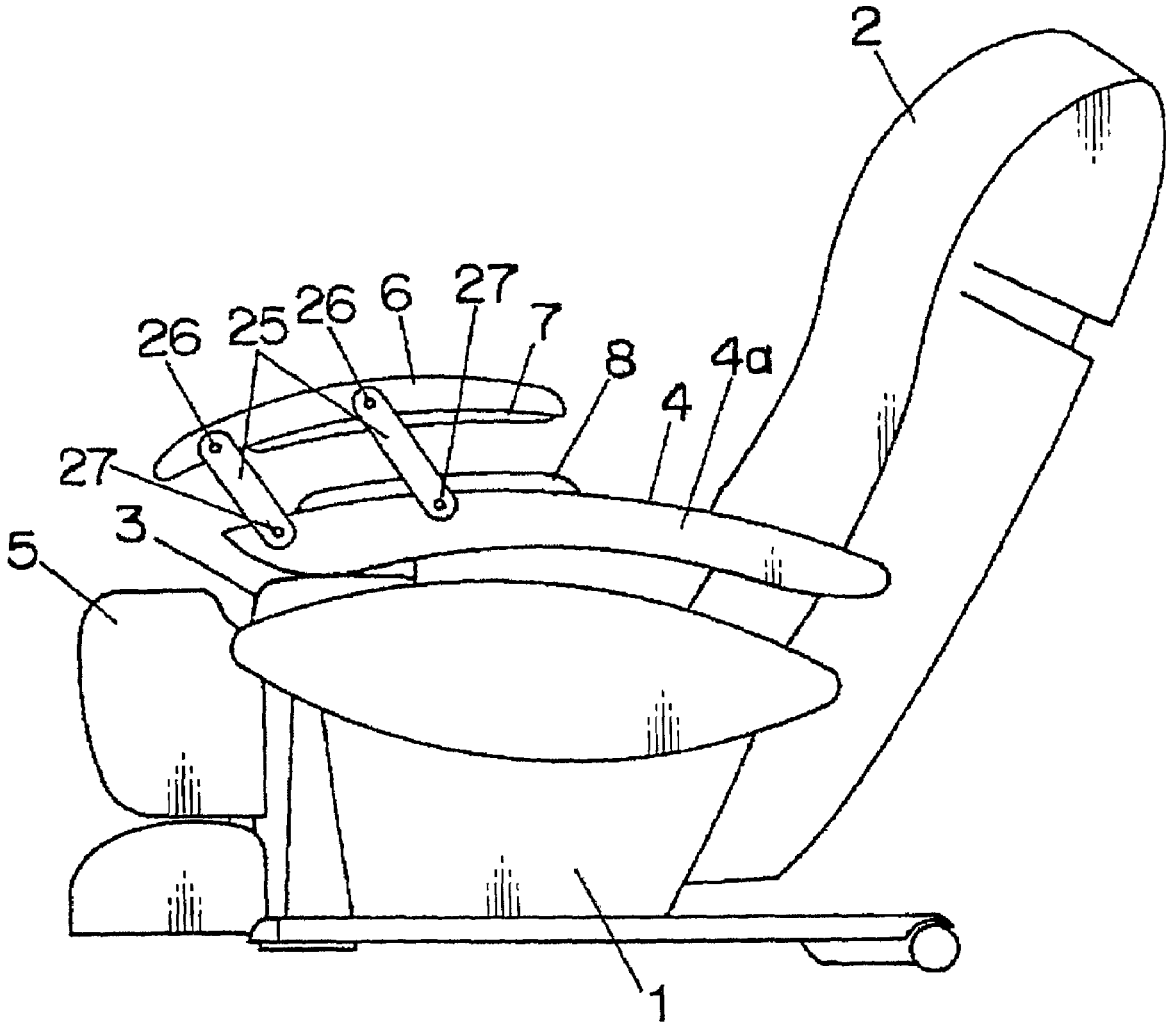
FIG. 5 is a side view of a massage chair according to a second modification of the embodiment.

First and second modifications shown in FIGS. 4 and 5 adopt other modes of opening and closing such covering members 6. Each covering member 6 shown in FIG. 4 is opened by being rotated toward the outer lateral side of the chair 1 about a supporting point 24 located at the widthwise outer side of the armrest main body 4*a*. Each covering member 6 shown in FIG. 5 is opened by being moved while being held at the substantially same angle by a pair of links 25, link supporting points 26 provided on the covering member 6 and link supporting points 27 provided on the armrest main body 4*a*.

In the case of having his hands and arms massaged while being seated in the chair 1, a user opens the covering members 6 as shown in FIG. 2, places his hands and arms between the lower surfaces of the covering members 6 and the upper surfaces of the armrest main bodies 4*a* and has his hands and arms massaged by driving the massaging devices 7, 8 with his hands and arms held between the covering members 6 and the armrest main bodies 4*a*.

When the hands and arms are not massaged, the covering members 6 are closed as shown in FIG. 3 to be usable as usual armrests by placing the hands and arms on the upper surfaces thereof.

If the covering members 6 are closed in this way when the hands and arms are not massaged, the hands and arms can be placed on the upper surfaces of the covering members 6 and hand and arm resting positions are not restricted. Thus, the user can relax without feeling tight.

Upon opening the covering members 6 to have the hands and arms massaged, the covering members 6 can be opened while being rotated upward about the supporting points 9 located at the front sides of the armrest main bodies 4*a* as shown in FIG. 2. Accordingly, spacing between the upper surface of each armrest main body 4*a* and the lower surface of the corresponding covering member 6 is narrower toward the front side of the armrest main body 4*a* and wider toward the rear end of the armrest main body 4*a*, thereby being similar to the thickness variation from the fingertips to the arms of a human. Thus, in the case of giving a massage by means of the air bags as the massaging devices 7, 8, the human body can be pressed with a small amount of air, wherefore an energy consumption amount of this massage chair can be suppressed.

Further, by shortening times required for suction and exhaust, a more effective and quicker massage can be given. In the case of causing treatment members to project and retract to massage a human body, a necessary projecting distance of the treatment members can be reduced. Thus, the size of driving mechanisms can be made smaller, which leads to a lighter weight and a better design of the massage chair.

As shown in FIGS. 2 and 3, each armrest main body 4*a* is formed with a slit 11 extending along a moving direction of the covering member 6, and a stay 17 mounted to the covering member 6 is provided with a pin 12, which is slidably fitted in the slit 11. An opening/closing range of the covering member 6 is determined by the slit 11 and the pin 12.

Between the pin 12 and a pin 14 mounted at a supporting point 13 located on each armrest main body 4*a* is provided a biasing member 15 for biasing the pins 12 and 14 in directions to widen spacing therebetween. The positions of the supporting points 9, 13 are such that the pin 12 is located below a straight line connecting the supporting points 9 and 13 with the covering member 6 completely closed while the pin 12 is located above this straight line with the covering member 6 opened.

Accordingly, if the pin 12 is located above the straight line connecting the supporting points 9 and 13 as shown in FIG. 2, a force is given to the covering member 6 in an opening direction. If the pin 12 is located below this straight line as shown in FIG. 3, a force is given to the covering member 6 in a closing direction. With the covering member 6 completely opened as shown in FIG. 2, the force from the biasing member 15 is greater than the weight of the covering member 6.

Specifically, by the above construction, the intensity of the biasing force of the biasing member 15 changes depending on the opening position of the covering member 6, and the force from the biasing force 15 and the weight of the covering member 6 balance out within an opening/closing range of the covering member 6. Accordingly, an upward-acting force of the biasing member 15 is greater than the weight of the covering member 6 if the covering member 6 is located further along the opening direction than a balanced position, whereas it is smaller than the weight of the covering member 6 if the covering member 6 is located further along the closing direction than the balanced position. The biasing member 15 may take advantage of an elastic force of a spring, a rubber or the like widely known in general or a magnetic force or may be realized by a cylinder filled with a high-pressure fluid and a piston.

In the case of biasing the covering member 6 by means of the biasing member 15 as described above, the covering member 6 does not move in the closing direction by itself despite the weight of its own. Thus, a series of operations for the massage including the opening of the covering member 6 and the placing of the hand and arm between the covering member 6 and the armrest main body 4*a* can be easily carried out by one hand. Further in the case of giving a massage by means of the air bags as the massaging devices 7, 8, the covering members 6 are not repeatedly opened and closed even when a user leaves the massage chair while the air bags still repeatedly expand and shrink. Thus, the covering members 6 can have a longer life. Furthermore, since the weight of the covering member 6 is canceled out by the biasing member 15, a force required to open the covering member 6 can be reduced.

Figure 6:
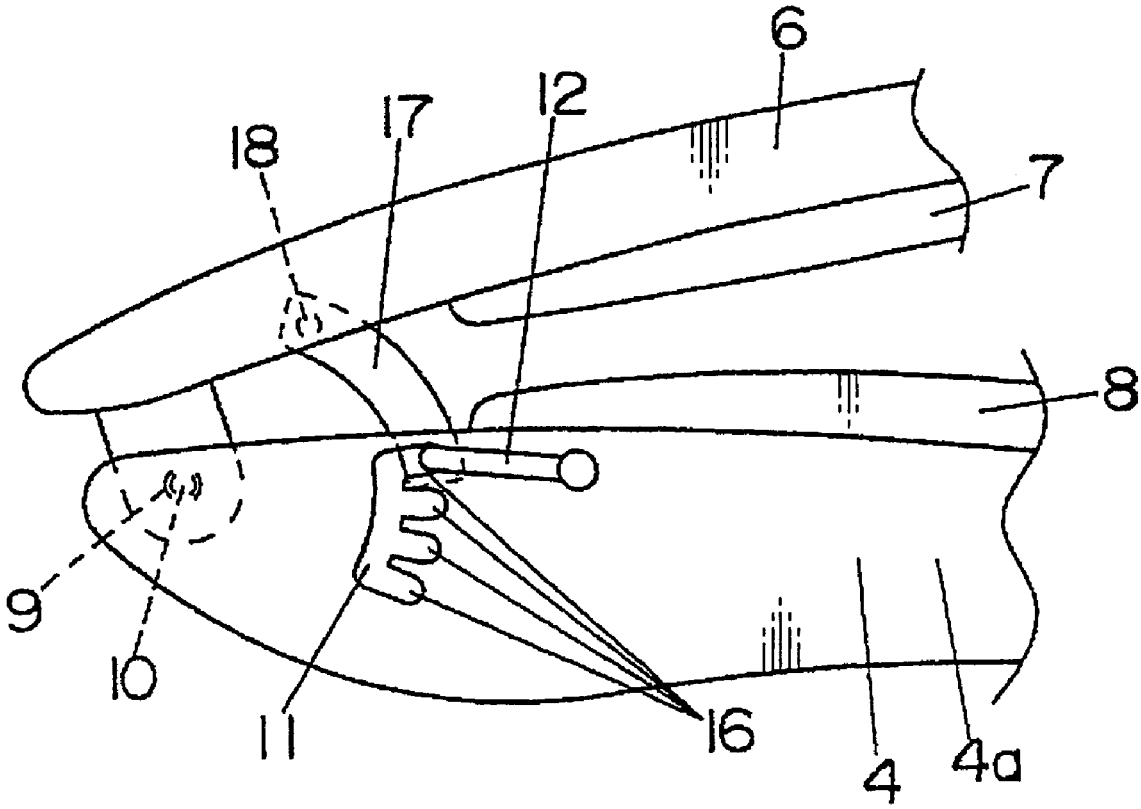
FIG. 6 is a side view enlargedly showing an essential portion of an armrest section of a massage chair according to a third modification of the embodiment.
Figure 7:
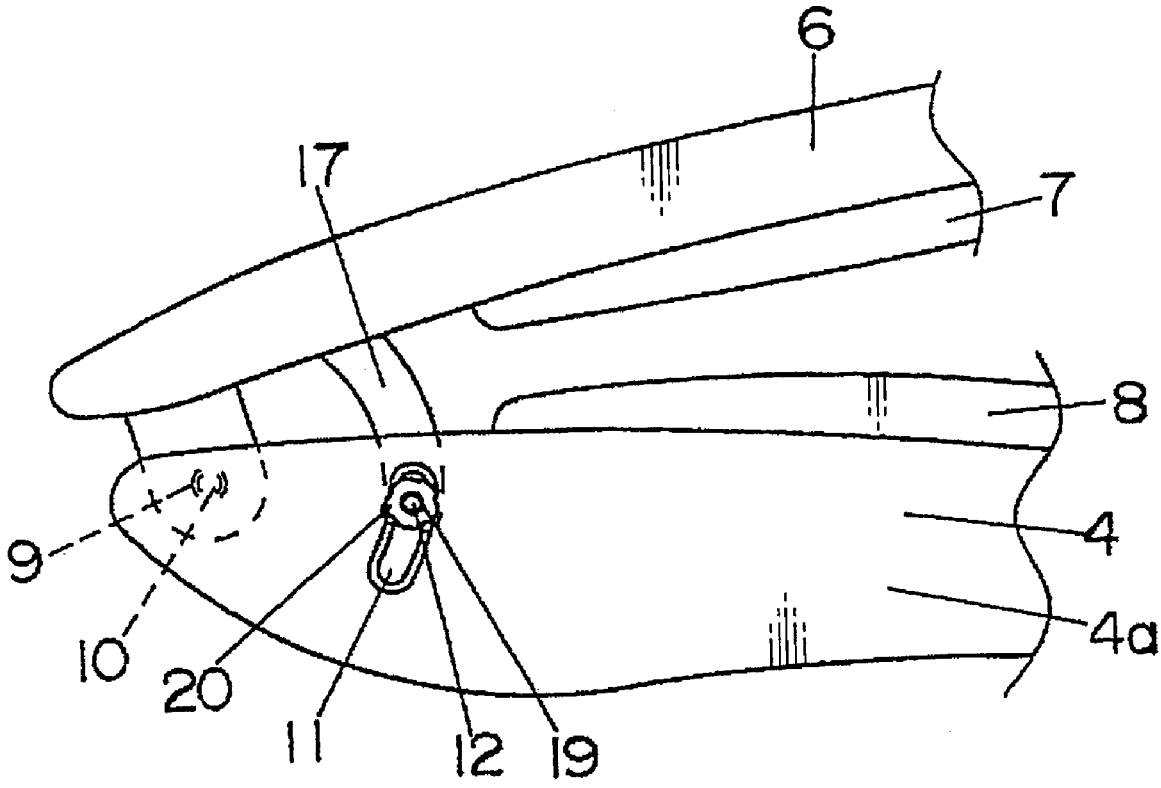
FIG. 7 is a side view enlargedly showing an essential portion of an armrest section of a massage chair according to a fourth modification of the embodiment.

In third and fourth modifications shown in FIGS. 6 and 7, the fixing angle of the covering member 6 can be adjusted when the covering member 6 is opened. In the third modification shown in FIG. 6, the slit 11 is formed with a plurality of locking grooves 16 extending in directions different from (substantially normal to) the opening and closing directions of the covering member 6. The stay 17 is rotatably mounted at a supporting point 18 of the covering member 6, the pin 12 mounted to the stay 17 is fitted in the slit 11, and the leading end of the pin 12 projects toward the outside of the armrest main body 4*a*. At an opening angle of the covering member 6 where the pin 12 corresponds to one of the locking grooves 16, the covering member 6 can be fixed by operating the leading end of the pin 12 to fit the pin 12 into the locking groove 16. In other words, the covering member 6 is fixed by engaging the pin 12 with a suitable locking groove 16 with the covering member 6 set at a desired opening angle.

In the fourth modification shown in FIG. 7, the pin 12 of the stay 17 fitted in the slit 11 is formed with an externally threaded portion 19, and the covering member 6 can be fixed at a desired position by fixing this externally threaded portion 19 with a nut 20.

If the fixing angle of the covering member 6 can be adjusted when the covering member 6 is opened as in the third and fourth modifications shown in FIGS. 6 and 7, the degree of opening can be adjusted in conformity with the thickness of the user's arm, and a pressing force and a pressing period of a specific massage can be obtained regardless of the thickness of the arm. Further, even if the pressing force given by the massaging devices 7, 8 is constant, a massaging force is bodily felt to be weak if the degree of opening is increased while being bodily felt to be strong if the degree of opening is decreased. Therefore, the massaging force can be easily adjusted to be weaker and stronger without controlling outputs of the massaging devices 7, 8.

In fifth to seventh modifications shown in FIGS. 8 to 12, only differences to the embodiment shown in FIGS. 1 to 5 are mainly described by leaving out the description of the same elements. The massaging devices 7, 8 provided on the upper surface of the armrest main body 4*a* and the lower surface of the covering member 6 are provided with projected portions 30 for point-pressing the hands and arms. In these modifications, the projected portions 30 are provided on the massaging device 7 on the lower surface of each covering member 6. The projected portions 30 include a projection for hand 30*a* for pressing a reflex point of the palm of the hand, Gokoku (or Hegu), (see FIG. 13) and a projection for arm 30*b* for pressing the arm.

Figure 8:
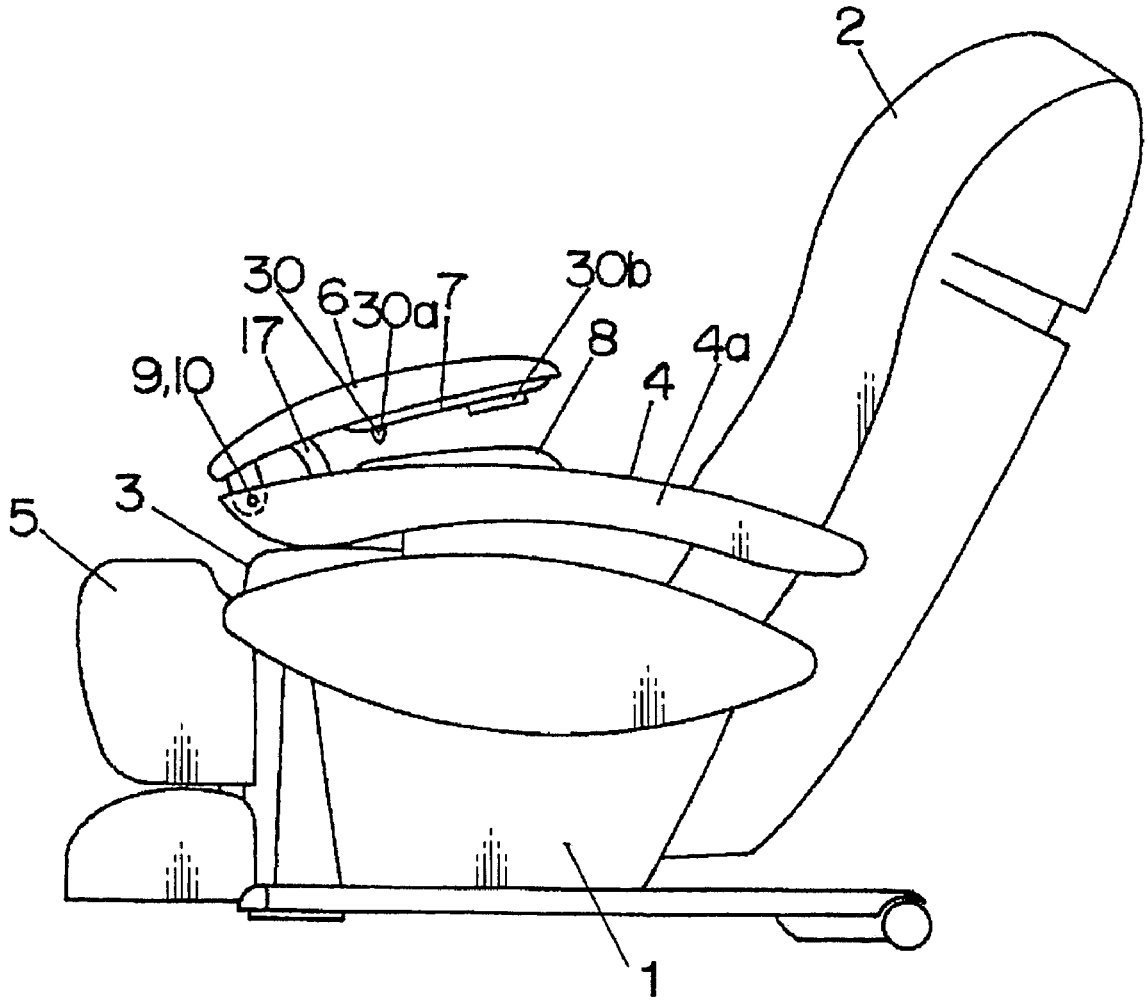
FIG. 8 is a side view of a massage chair according to a fifth modification of the embodiment.
Figure 9:
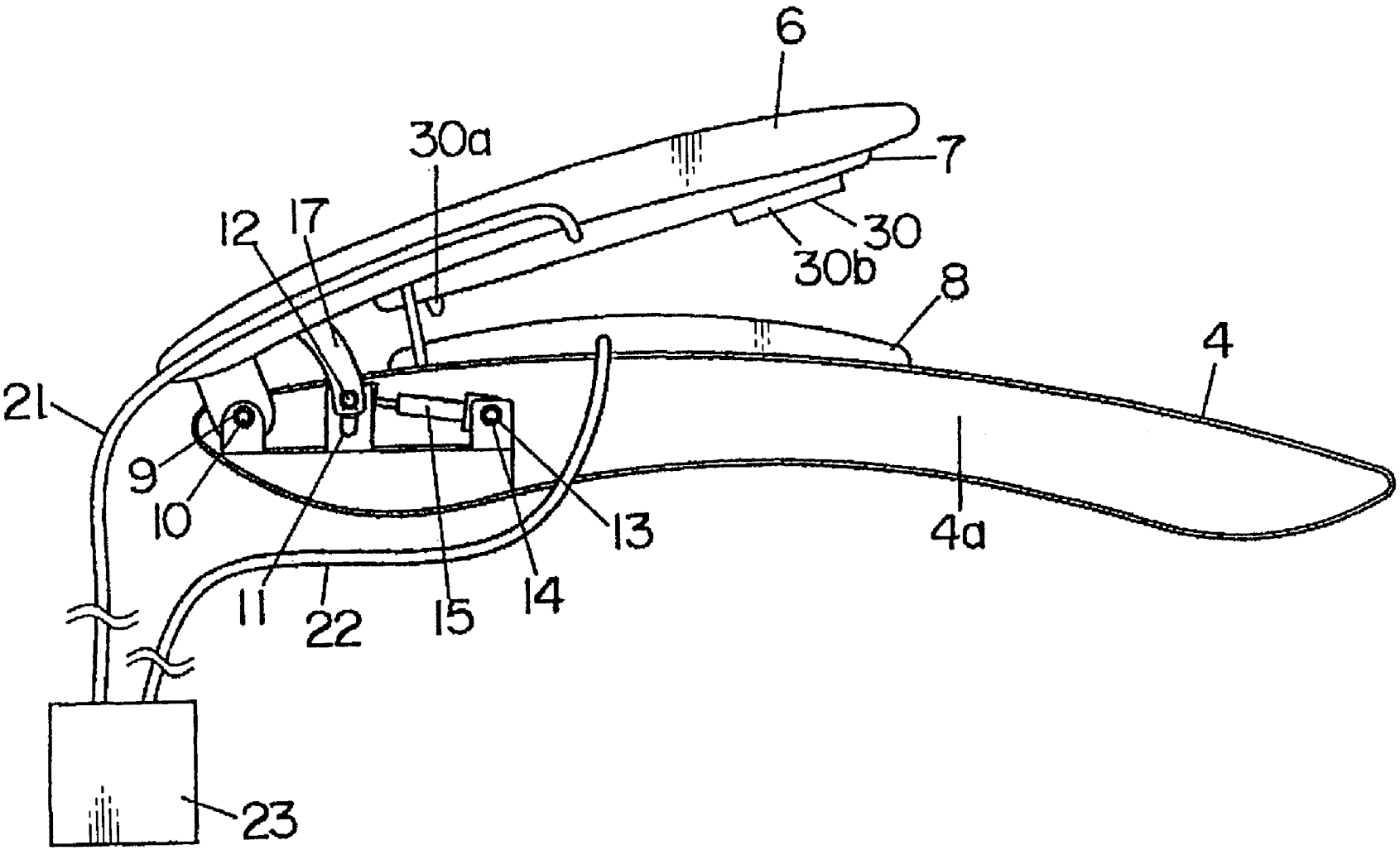
FIG. 9 is a side view partly in section enlargedly showing an armrest section of the fifth modified massage chair with a covering member opened.
Figure 10:
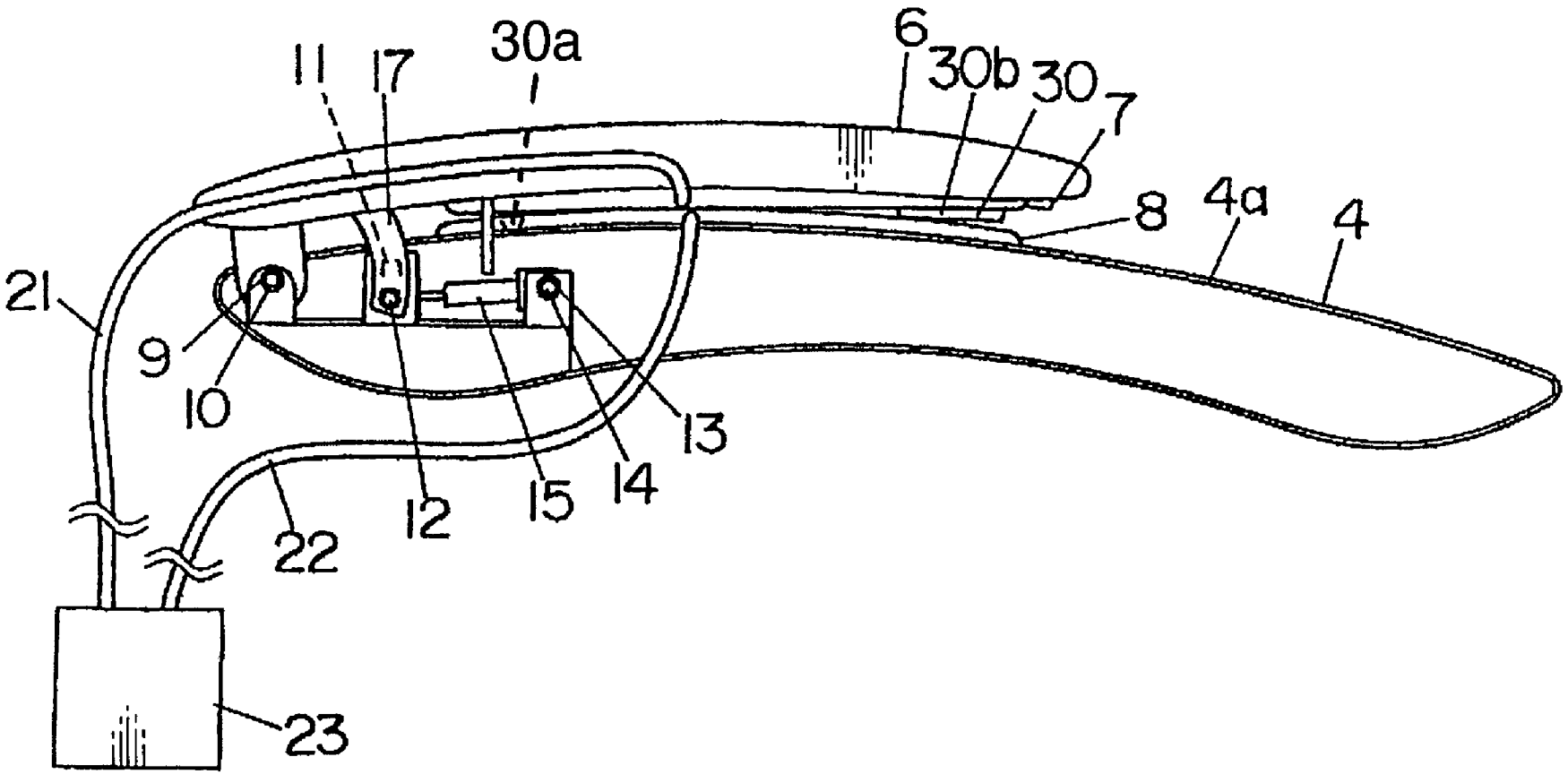
FIG. 10 is a side view partly in section enlargedly showing the armrest section of the fifth modified massage chair with the covering member closed.
Figure 11:
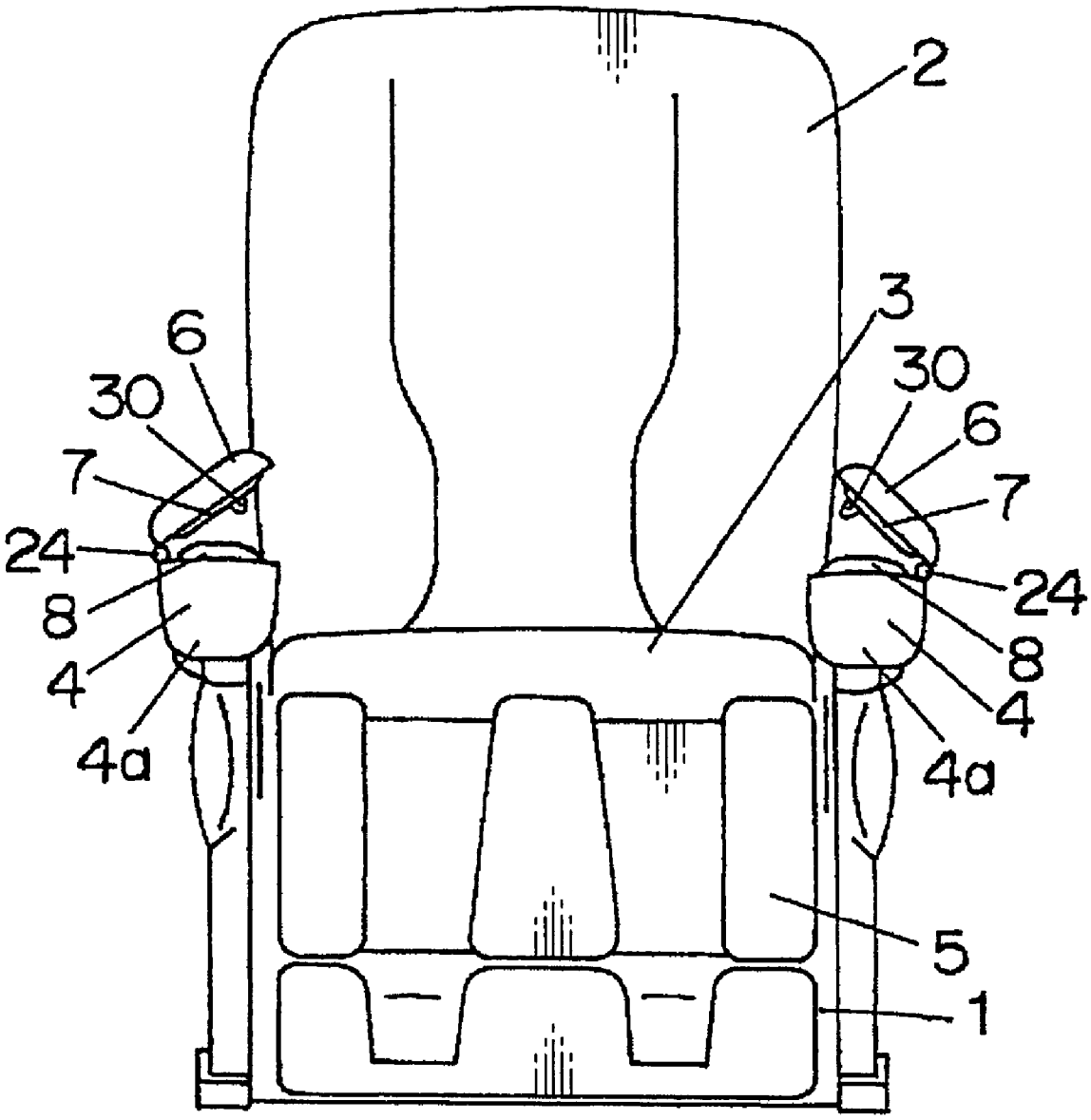
FIG. 11 is a front view of a massage chair according to a sixth modification of the embodiment.
Figure 12:
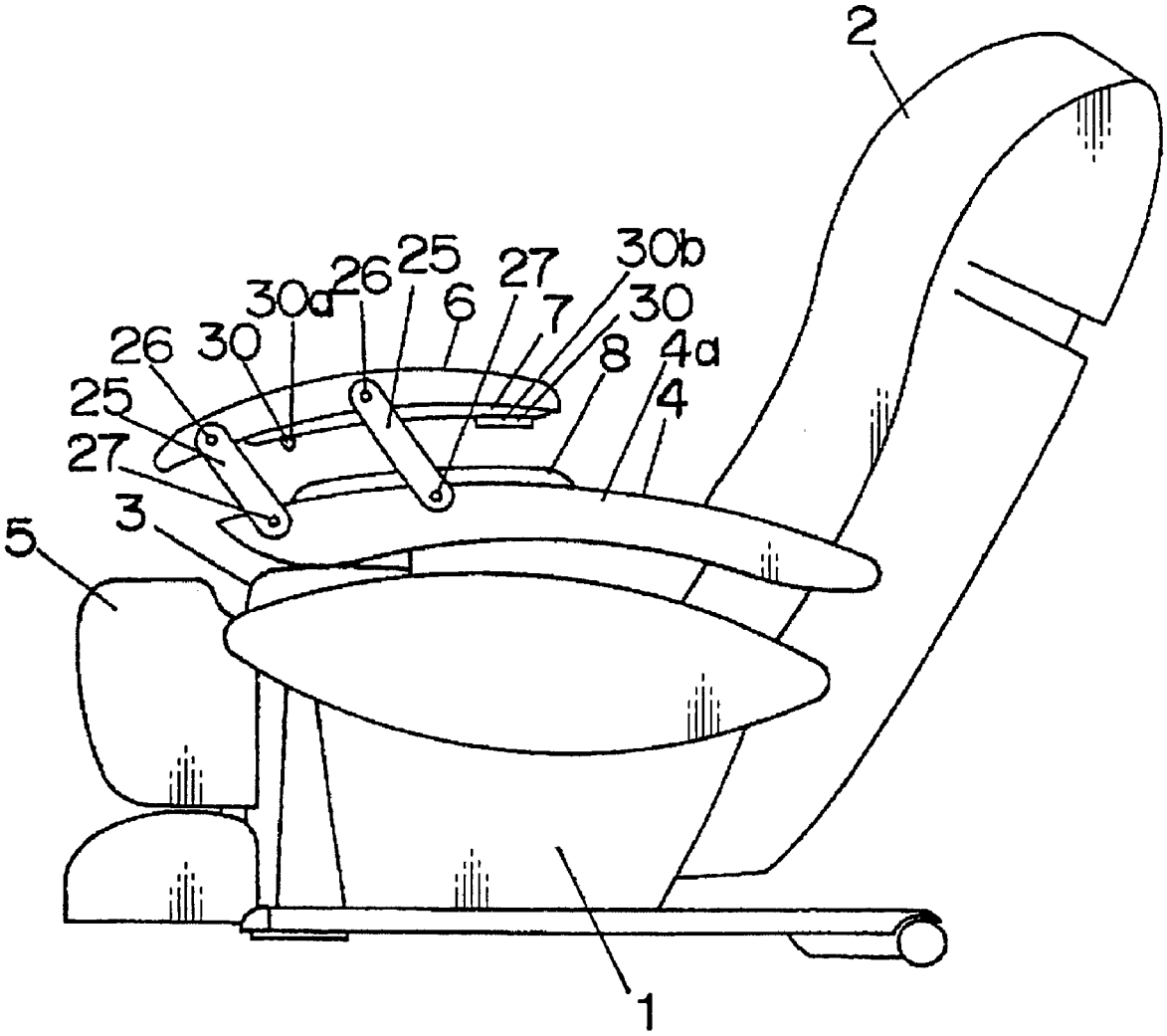
FIG. 12 is a side view of a massage chair according to a seventh modification of the embodiment.

In the case of providing these projected portions 30, the covering member 6 may be rotatably supported by the pin 10 about the supporting point 9 located at the front side of the armrest main body 4*a* as shown in FIGS. 8 to 10, or may be opened while being rotated toward the outer lateral side about the supporting point 24 located at the outer widthwise side of the armrest main body 4*a* as shown in FIG. 11, or may be opened by being moved while being held at substantially the same angle by a pair of links 25, the link supporting points 26 provided on the covering member 6 and the link supporting points 27 provided on the armrest main body 4*a* as shown in FIG. 12.

In the modifications shown in FIGS. 8 to 12, the user can open the covering members 6 while being seated in the chair 1 in a usual manner and placing his hands and arms placed on the armrests 4, and can have hands and arms massaged by driving the massaging devices 7, 8 with the hands and arms held between the lower surfaces of the covering members 6 and the upper surfaces of the armrest main bodies 4*a*. At this time, the projected portions 30 press the hands and arms to give the point stimulation, thereby giving the user the feeling of being slightly strongly massaged. The projections for hand 30*a* can effectively press the Gokoku reflex points 31 to adjust the function of the large intestine.

Figure 13:
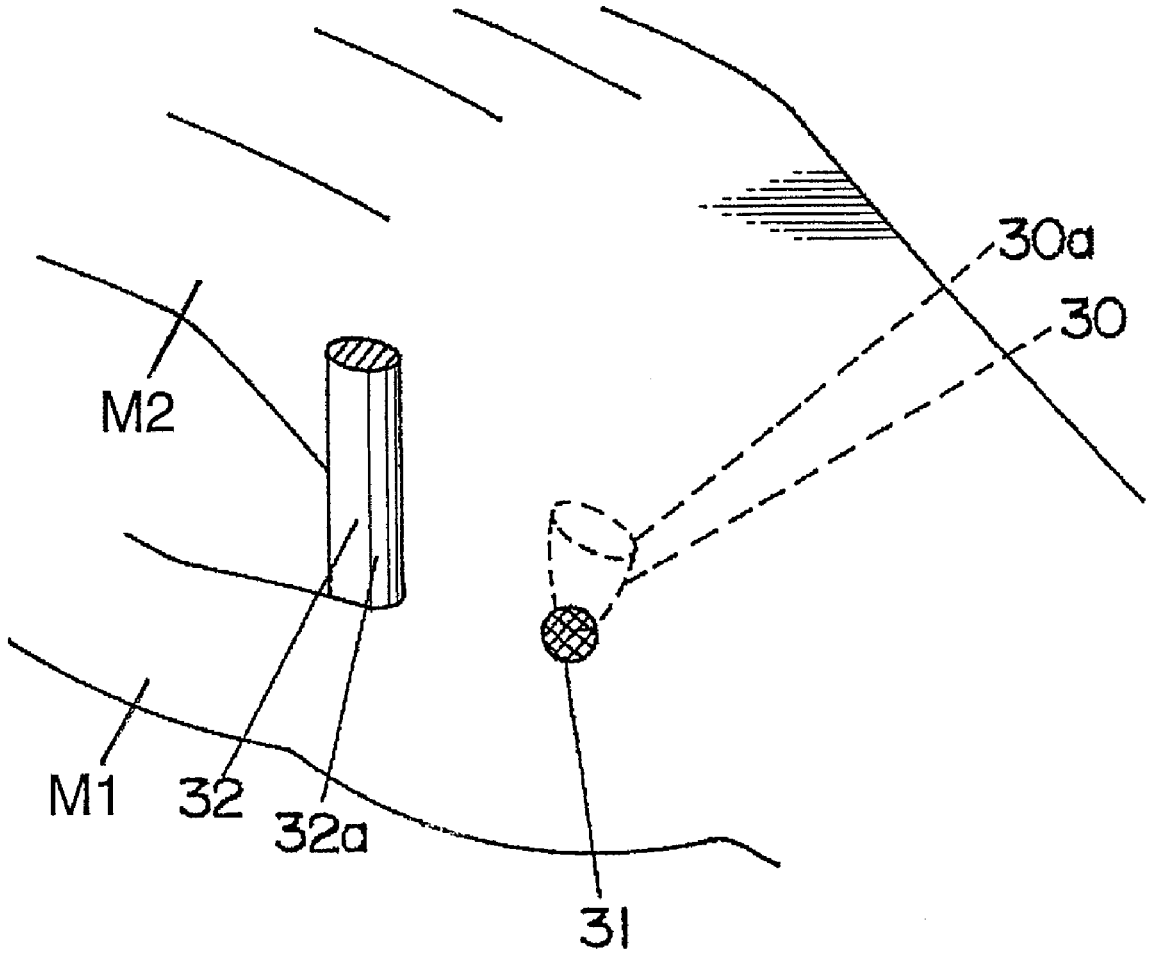
FIG. 13 is an enlarged perspective view showing an essential portion of a positioning mechanism of a massage chair according to an eighth modification of the embodiment.

An eighth modification shown in FIG. 13 is provided with positioning mechanisms 32 for bringing the projections for hand 30*a* into alignment with the Gokoku reflex points 31. Each positioning mechanism 32 is formed by a round bar 32*a* fixed to the covering member 6 or the armrest main body 4*a*, and the projection for hand 30*a* and the Gokoku reflex point 31 can be brought into alignment by placing the round bar 32*a* at a deepest part of a concave portion coupling the base ends of a thumb M1 and a forefinger M2 of the hand. Although such a positioning mechanism 32 is formed by the round bar 32*a* in this embodiment, it may be formed by an elastic member such as a spring or a rubber string fixed to the covering member 6 or the armrest main body 4*a* and extendible and contractible as the covering member 6 is opened and closed.

If such a positioning mechanism 32 is provided, the projection for hand 30*a* and the position of the Gokoku reflex point 31 can be easily brought into alignment without being visually confirmed only by inserting the hand between the lower surface of the covering member 6 and the upper surface of the armrest main body 4*a* with the covering member 6 opened. This can prevent the projection for hand 30*a* from giving the point stimulation at a wrong position on the back of the hand.

Figure 14:
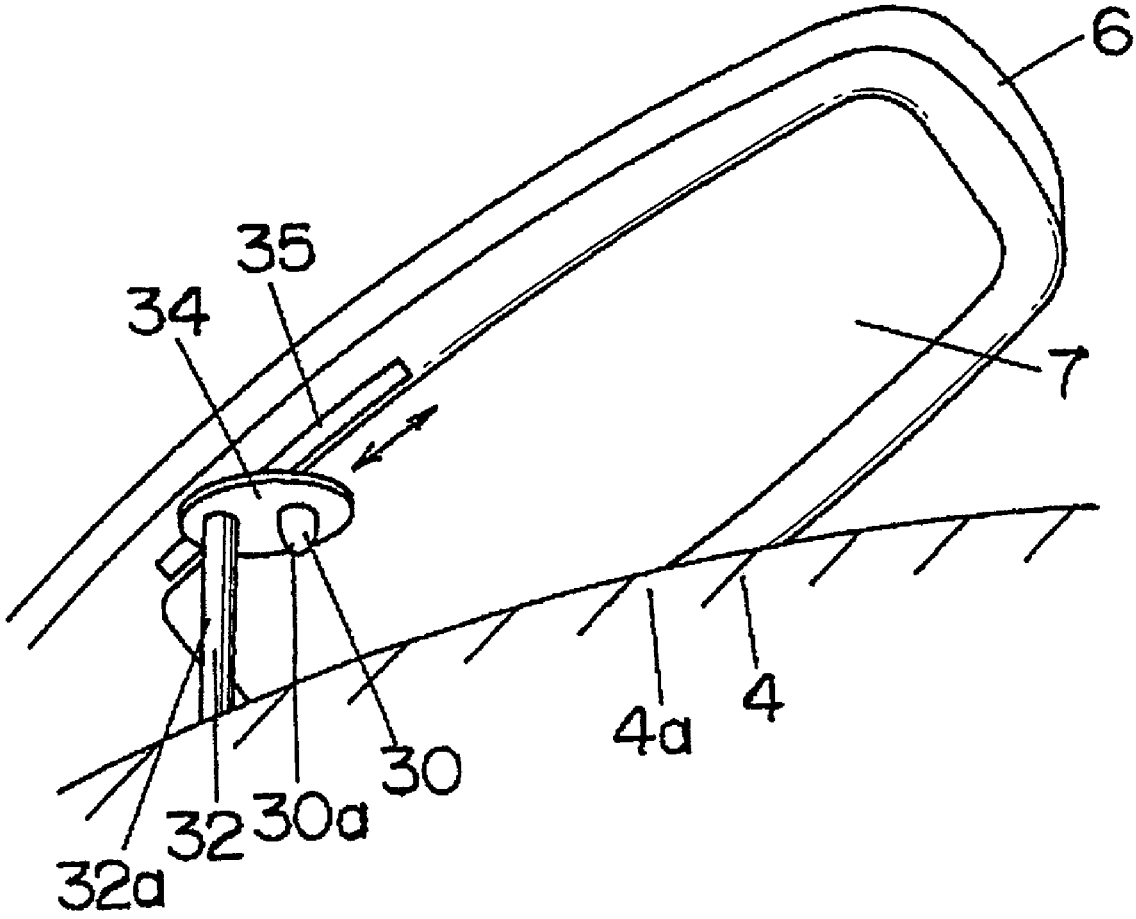
FIG. 14 is an enlarged perspective view showing an essential portion of an armrest section of a massage chair according to a ninth modification of the embodiment.

In a ninth modification shown in FIG. 14, the projected portions 30 are provided separately from the massaging device 7 and are movable in directions along the hands and arms. In this modification, the projections for hand 30*a* are movably provided. The projection for hand 30*a* and the round bar 32*a* of the positioning mechanism 32 are integrally provided on a base 3.4, and the round bar 32*a* is slidably mounted in a slit 35 formed in the covering member 6 or the armrest main body 4*a*.

With this construction, the projection for hand 30*a* and the round bar 32*a* can be moved in directions along the hand and arm and, even if the positions of the hand and arm relative to the armrest section 4 change upon reclining the backrest 2, the projection for hand 30*a* and the round bar 32*a* can be moved accordingly. Thus, even if the backrest 2 is reclined, the projection for hand 30*a* can be brought into alignment with the Gokoku reflex point 31 to properly give the point stimulation thereto.

Figure 15:
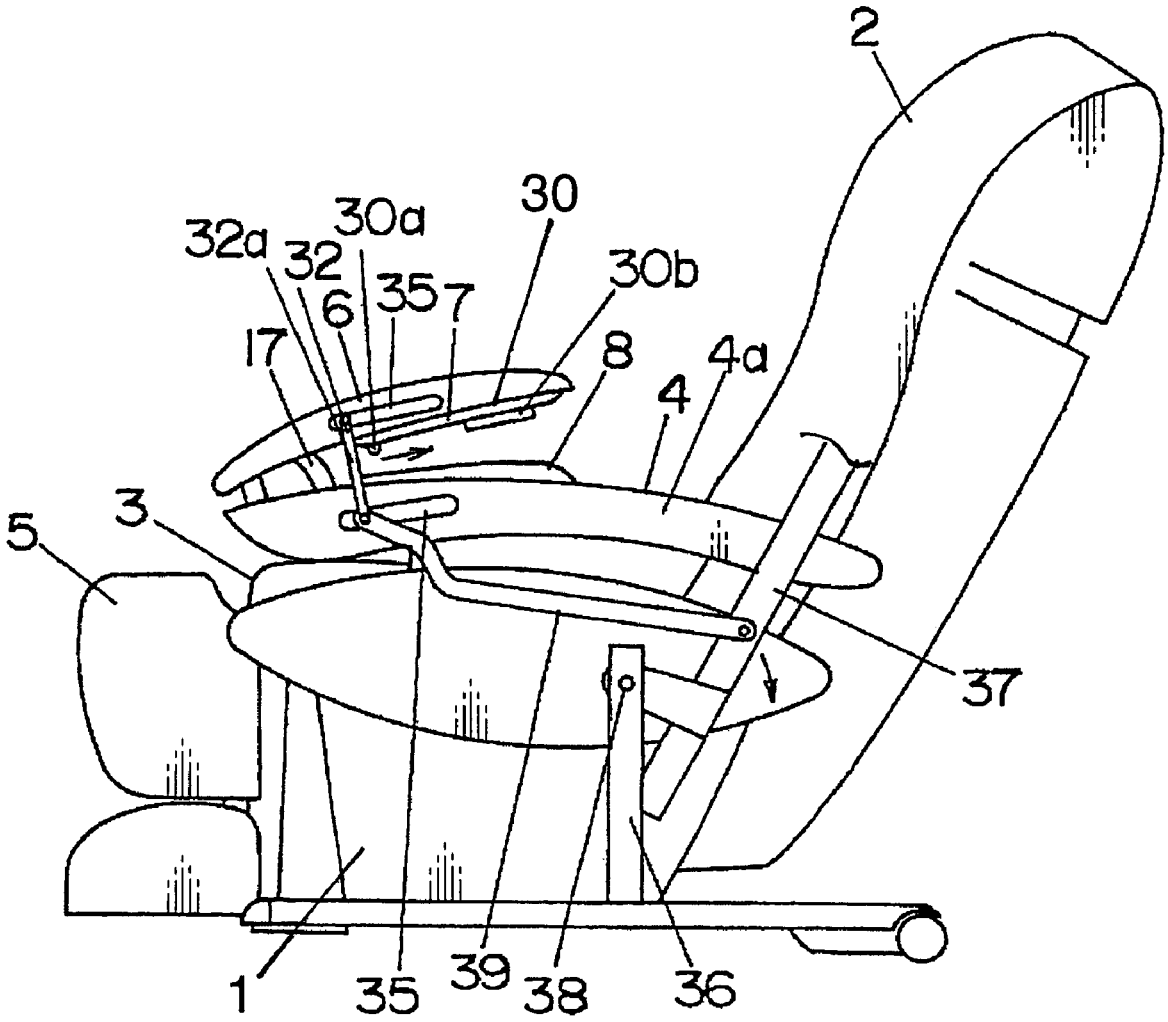
FIG. 15 is a side view of a massage chair according to a tenth modification of the embodiment.

In a tenth modification shown in FIG. 15, the movements of the projections for hand 30*a* as the projected portions 30 and the round bars 32*a* as the positioning mechanism 32 are linked with the reclining movement of the backrest 2. Seat frames 36 for the seating surface 3 and rear frames 37 for the backrest 2 are rotatably coupled to each other at reclining points 38. The projections for hand 30*a* and the round bars 32*a* are movably mounted in the slits 35, and the round bars 32*a* and the rear frames 37 are coupled via links 39.

With this construction, the projections for hand 30*a* and the round bars 32*a* are moved as the backrest 2 is reclined. Accordingly, even if a user does not move the projections for hand 30*a* for the position adjustment every time the backrest 2 is reclined or returned, the projections for hand 30*a* are moved as the backrest 2 is moved, thereby being brought into alignment with the Gokoku reflex points 31. As a result, the point stimulation can be properly given to the Gokoku reflex points 31.

Figure 16B:
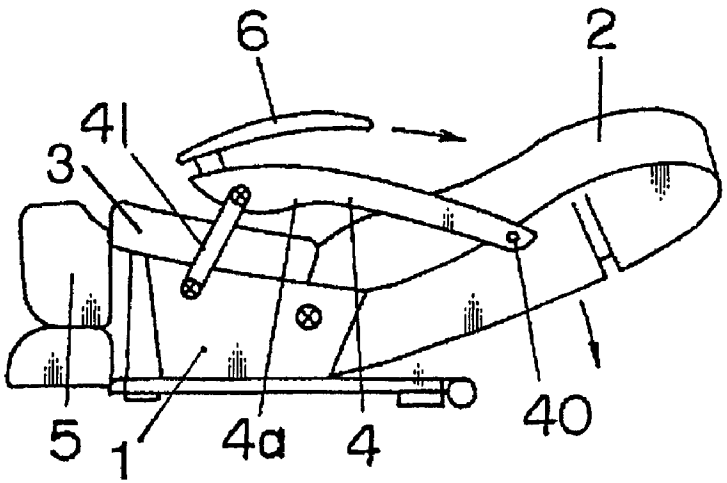
FIGS. 16A and 16B are side views of a massage chair according to an eleventh modification of the embodiment.
Figure 16A:
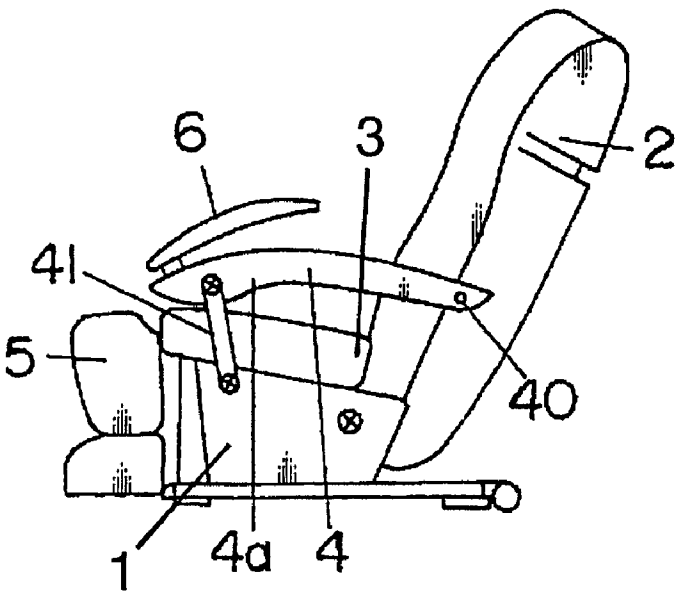
Figure 17B:
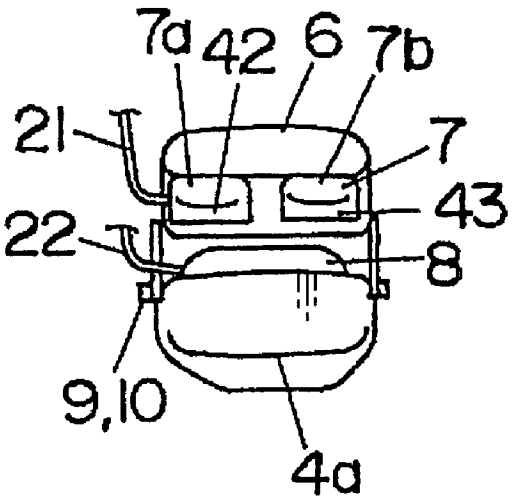
FIGS. 17A and 17B are a side view and a front view enlargedly showing an armrest section of a massage chair according to a twelfth modification with a covering member opened.
Figure 17A:
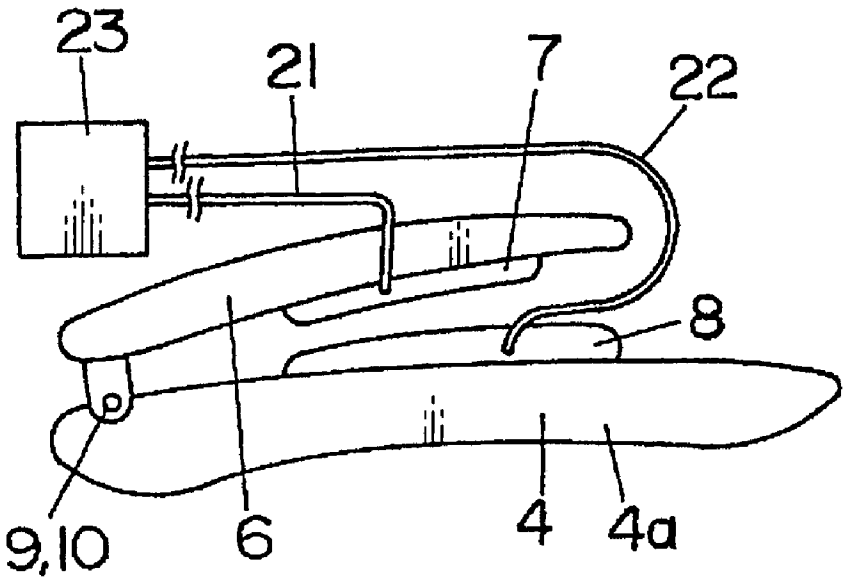
Figure 18B:
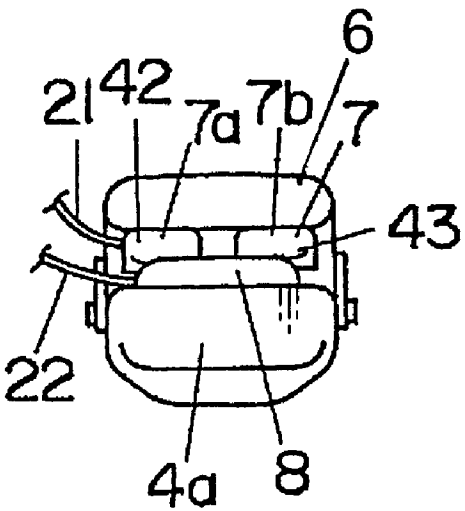
FIGS. 18A and 18B are a side view and a front view enlargedly showing the armrest section according to the twelfth modification with the covering member closed.
Figure 18A:
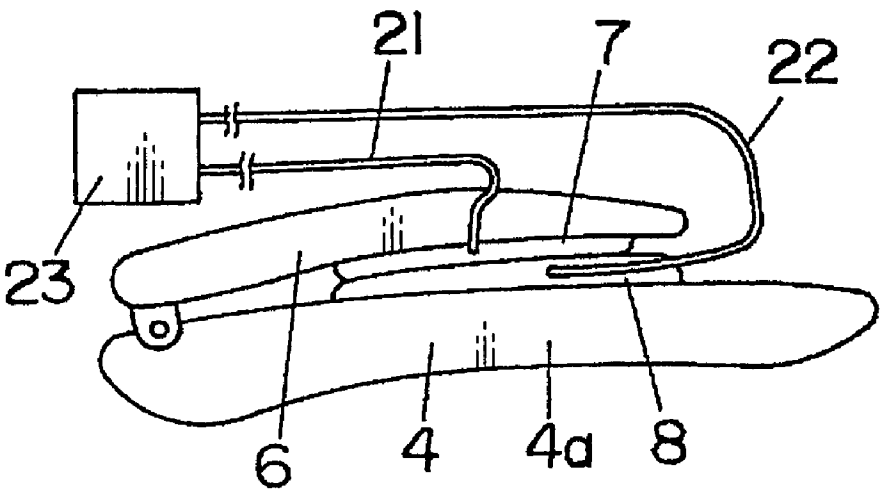

In an eleventh modification shown in FIGS. 16A and 16B, the entire armrests 4 are moved backward and forward as the backrest 2 of the chair 1 is reclined and returned. The rear ends of the armrest main bodies 4*a* of the armrests 4 are rotatably coupled to the backrest 2 via rotatable shafts 40, and the front sides of the armrest main bodies 4*a* are coupled to the seating surface 3 via links 41. In this way, the armrests 4 are moved backward and forward as the backrest 2 is reclined and returned as shown in FIGS. 16A and 16B.

With this construction, the projections for hand 30*a* as the projected portions 30 are brought into alignment with the Gokoku reflex points 31 as the backrest 2 is moved and, in addition, the armrests 4 are located at positions corresponding to the backrest 2 even when the hands and arms are not massaged, thereby being more easily usable as usual armrests.

A twelfth modification shown in FIGS. 17A, 17B, 18A and 18B is mainly described only in points different from the embodiment shown in FIGS. 1 to 3 by leaving out the description on the same construction. The massaging devices 7, 8 are provided on the lower surface of the covering member 6 and the upper surface of the armrest main body 4*a*, respectively. The massaging device 7 provided on the lower surface of the covering member 6 is comprised of two massaging members 7*a*, 7*b* juxtaposed along the widthwise direction of the arm. These two massaging members 7*a*, 7*b* are formed by expandable and shrinkable air bags 42, 43 and air is supplied thereto from a compressed air supplier 23 via air supplying pipes 21, 22.

The covering members 6 are opened, and the hands and arms are held between the covering members 6 and the armrest main bodies 4*a* to be massaged by driving the massaging members 7*a*, 7*b* and the massaging device 8. A strong massage can be given because each arm can be squeezed by the two air bags 42, 43 as the two massaging members 7*a*, 7*b*. Although the two massaging members 7*a*, 7*b* are the air bags 42, 43 which press a human body through the expansions by means of the compressed air in this embodiment, treatment members may be caused to project and retract to press a human body.

Figure 19B:
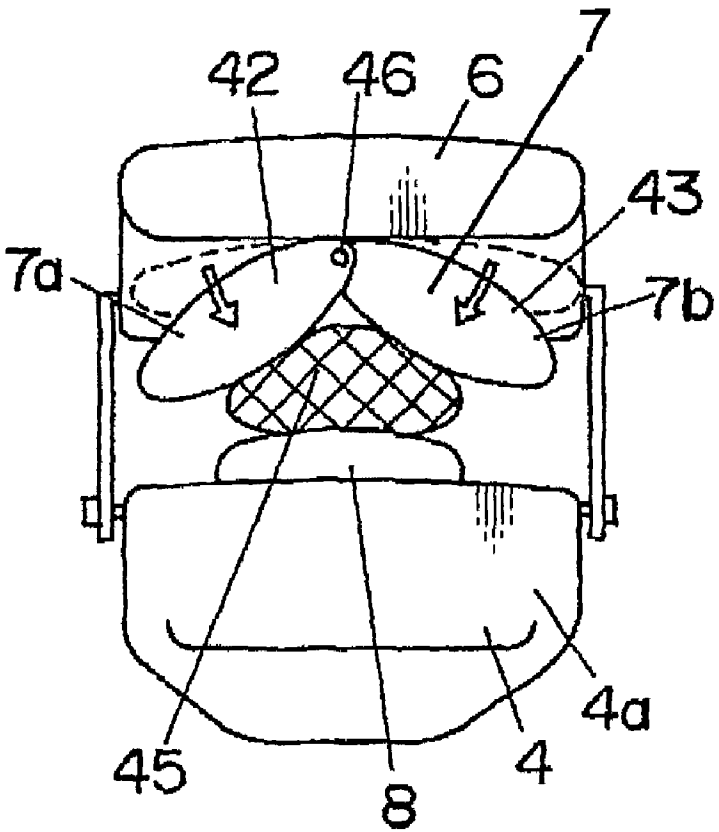
FIGS. 19A and 19B are front views partly in section showing an essential portion of an armrest section of a massage chair according to a thirteenth modification of the embodiment.
Figure 19A:
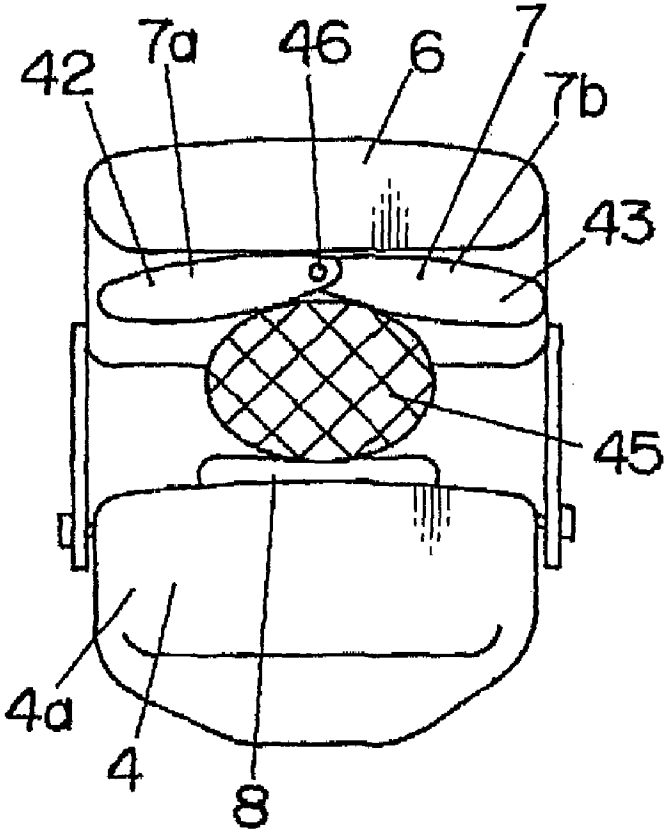

In a thirteenth modification shown in FIGS. 19A and 19B, the air bags 42, 43 as the two massaging members 7*a*, 7*b* are arranged at the opposite sides of the centerline of each arm 45 of a user, a supporting point 46 of movements is located on the centerline of the arm 45. In this case, the air bags 42, 43 expand from a state of FIG. 19A to a state of FIG. 19B. Since the supporting points 46 are located at the centers of the arms 45 during the expansion of the air bags 42, 43, the arms 45 can be massaged while being squeezed from the opposite lateral sides, whereby muscles in upper parts of the arms 45 can be effectively massaged. In other words, such a massage as would be actually given by a person while squeezing the arm from the opposite outer lateral sides can be given to muscles (brachio-radialis) at the upper side of the arm 45 of the human body which are regarded to particularly easily get tired.

Figure 20B:
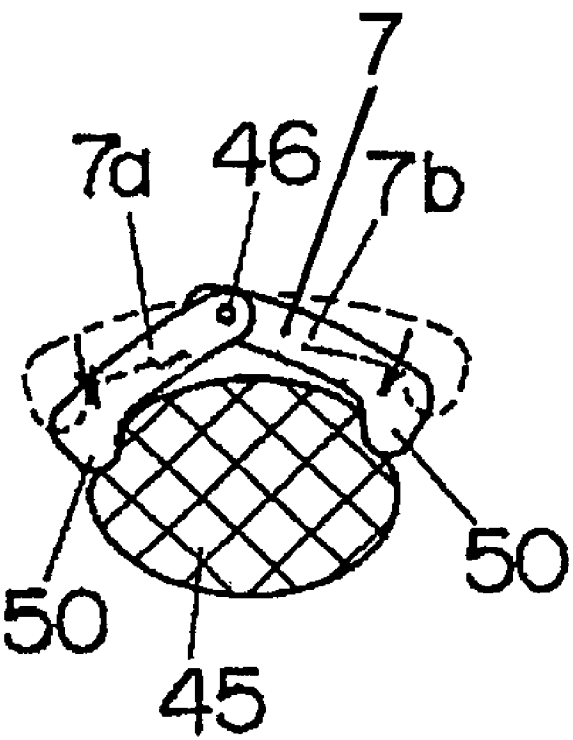
FIGS. 20A and 20B are front views partly in section showing an essential portion of an armrest section of a massage chair according to a fourteenth modification of the embodiment.
Figure 20A:
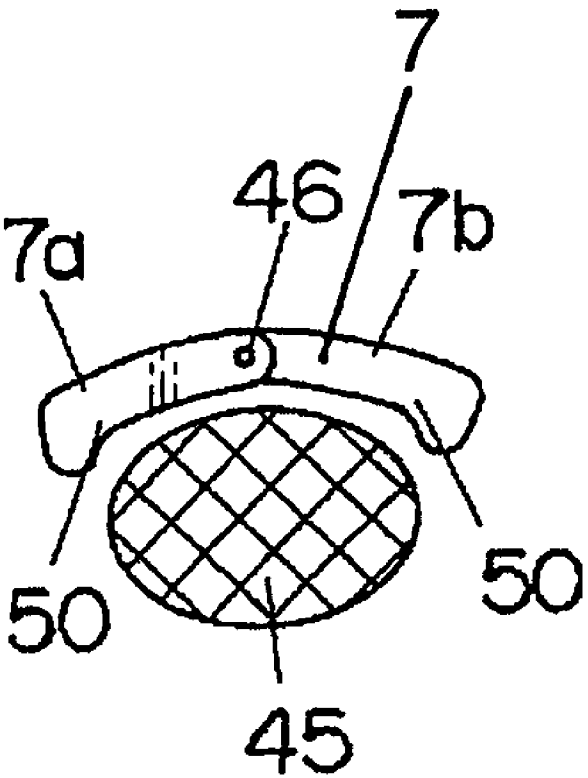

Even if treatment members 50 as shown in FIGS. 20A and 20B showing a fourteenth modification are used as the massaging members 7*a*, 7*b* other than the air bags 42, 43, similar effects can be obtained.

Figure 21B:
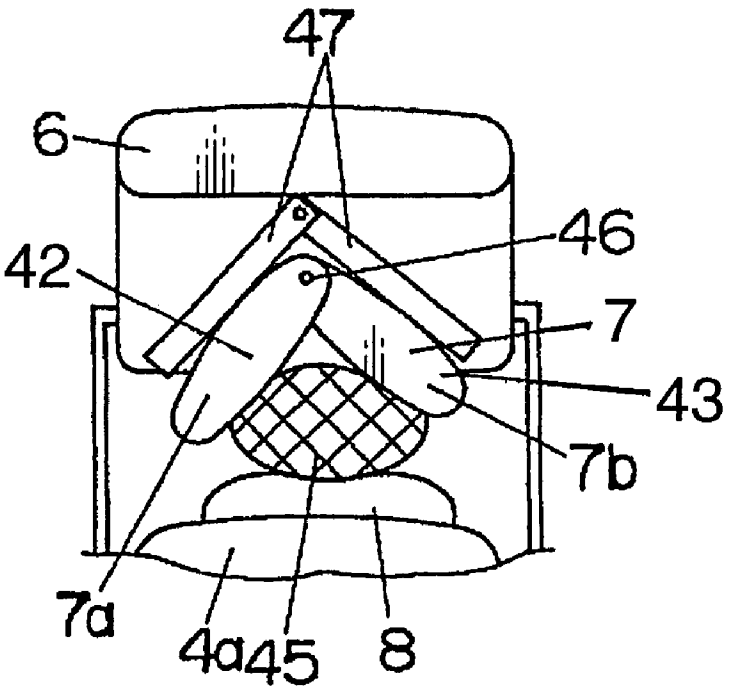
FIGS. 21A and 21B are front views partly in section showing an essential portion of an armrest section of a massage chair according to a fifteenth modification of the embodiment.
Figure 21A:
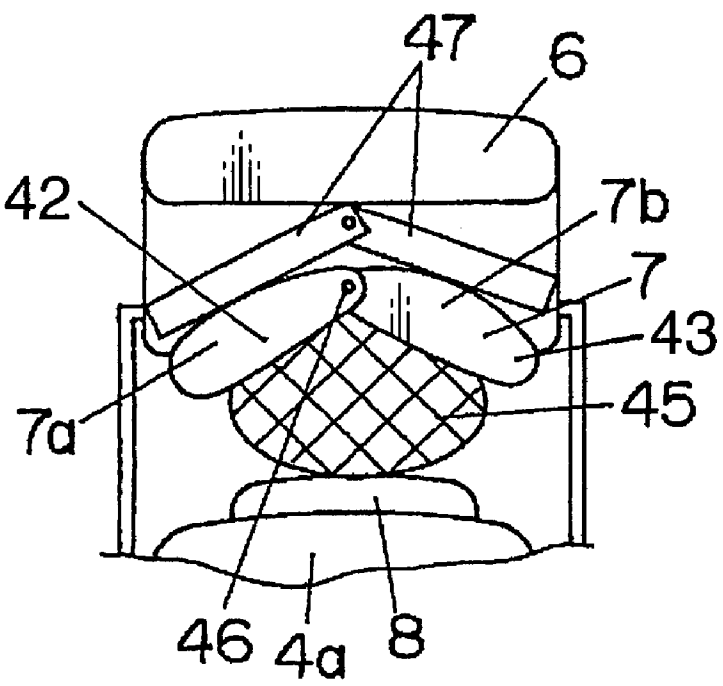

In a fifteenth modification shown in FIGS. 21A and 21B, a position adjusting device 47 for adjusting the positions of the air bags 42, 43 are provided behind the air bags 42, 43 as the two massaging members 7*a*, 7*b*, so that the positions of the air bags 42, 43 can be adjusted according to the thickness of the arm 45 to provide a specific massage feeling. FIG. 21A shows a case where the arm 45 is thick and FIG. 21B shows a case where the arm 45 is thin.

In the case of adjusting the positions of the air bags 42, 43 by the position adjusting device 47, a difference in the massage feeling due to the thickness of the arm 45 (e.g. painful massage to a person having thick arms and weak massage to a person having thin arms) can be solved, wherefore a stable feeling of being massage can be given to any person.

Figure 22B:
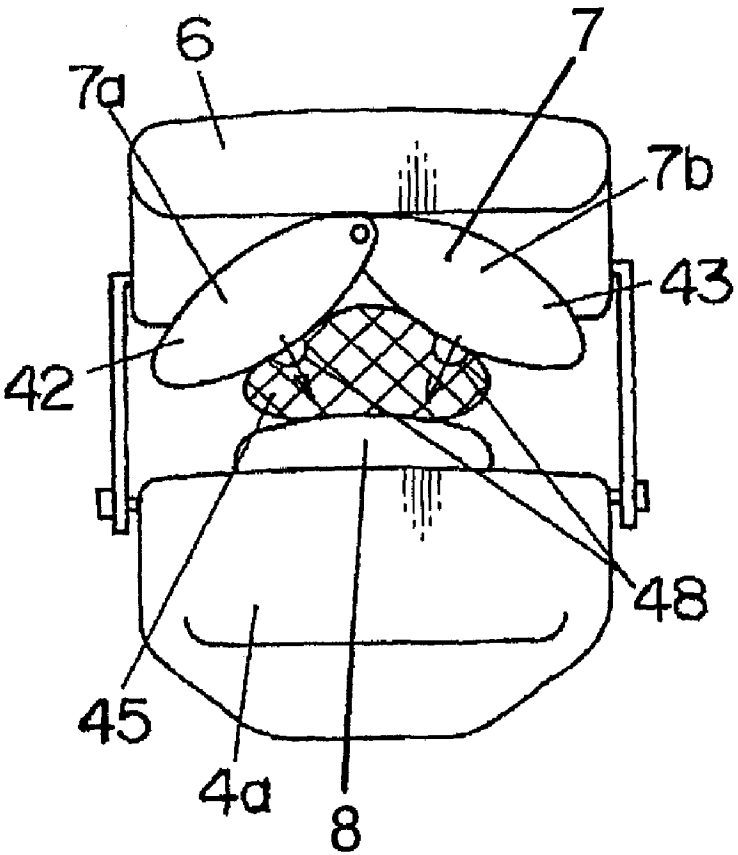
FIGS. 22A and 22B are front views partly in section showing an essential portion of an armrest section of a massage chair according to a sixteenth modification of the embodiment.
Figure 22A:
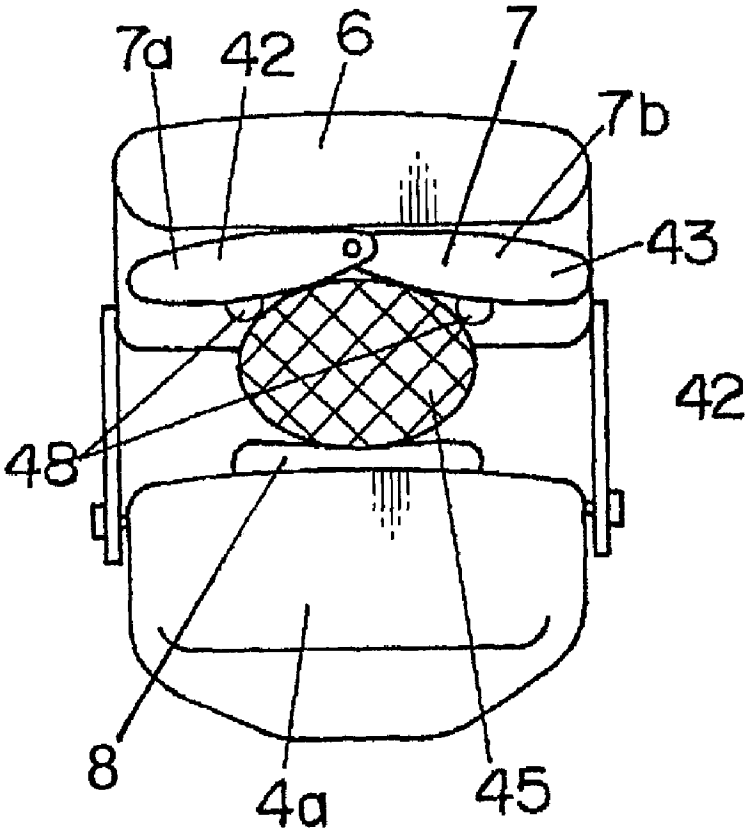

In a sixteenth modification shown in FIGS. 22A and 22B, the air bags 42, 43 as the two massaging members 7*a*, 7*b* are provided with projection-shaped treatment members 48, wherefore an effective massage can be given. by more strongly stimulating tired parts of the arms 45.

With this construction, in addition to the massage to the entire upper sides of the arms 45, strong stimulation can be given to Tesanri, Kyokuchi, Shitoku or other reflex points in the brachio-radialis muscles at the upper sides of the arms.

Figure 23:
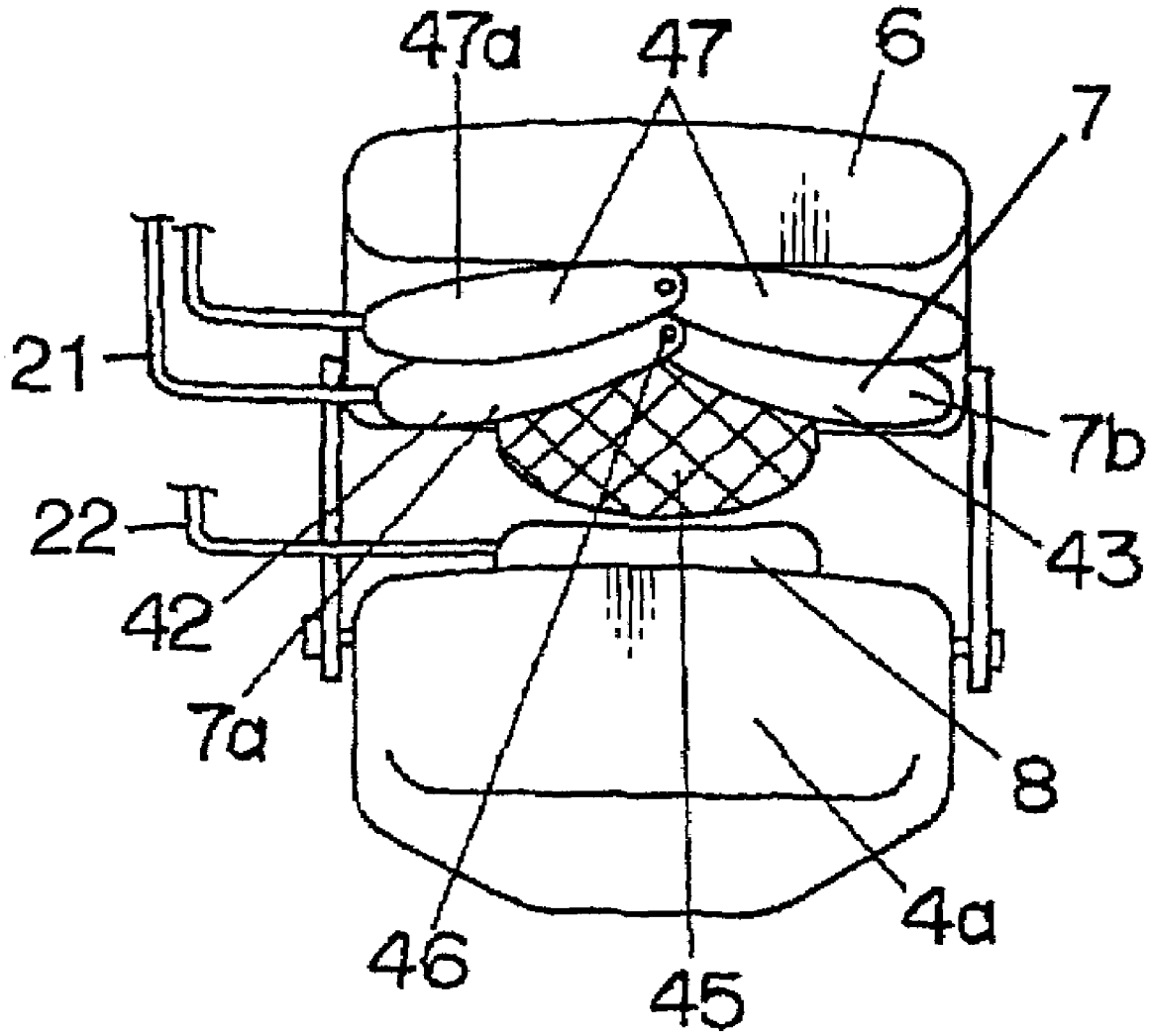
FIG. 23 is a side view of a massage chair according to a seventeenth modification of the embodiment.

In a seventeenth modification shown in FIG. 23, the position adjusting device 47 are expandable and shrinkable air bags 47*a*. In such a case, the same driving source as the one for the massaging members 7*a*, 7*b* and the massaging device 8 can be used for the position adjusting device 47, obviating the need for providing another driving source. Thus, an installation space in the massage chair can be saved. Further, by using the air bags 47*a*, a soft massage feeling that would be given by a person can be given.

Another problem of the prior art is that the hand and arm resting positions are restricted since the armrest sections provided with the device for massaging the hands and arms are integrally fixed to the chair main body. Further, no massage can be given depending on the thickness of the arms since the standing wall are provided. If an attempt is made to massage the hands and arms in wide areas by eliminating the standing walls, it inevitably ends up with the larger armrests. Thus, if an attempt is made to move the massage chair with the large armrests left mounted, the massage chair may not pass an opening of a room door or a corridor by being hindered by the armrests. Therefore, it is not possible to provide the armrest sections capable of massaging the hands and arms in wire areas.

Accordingly, there has been a demand for a massage chair which can be used without facing the problem of the restricted hand and arm resting positions when the hands and arms are not massaged while being able to massage the hands and arms in wide areas when they are massaged.

Figure 24:
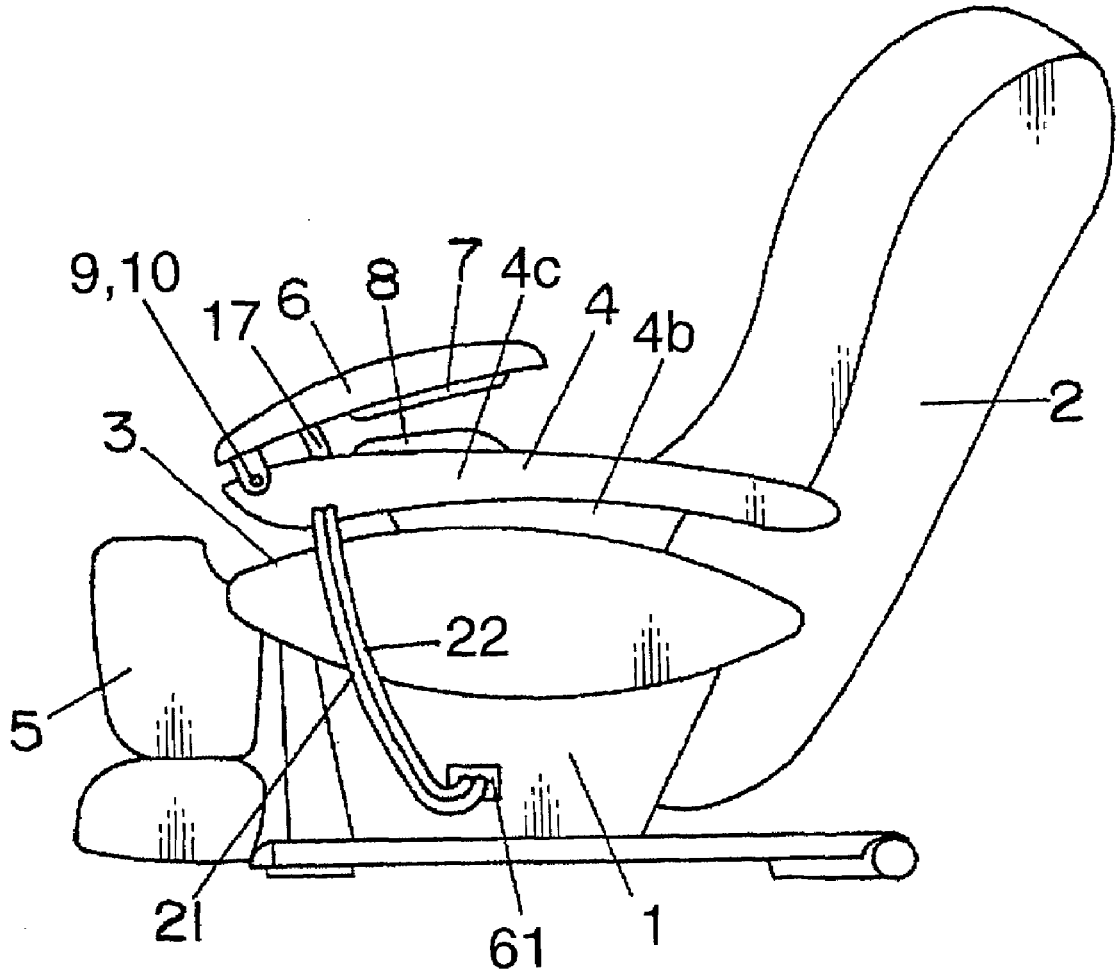
FIG. 24 is a side view of a massage chair according to an eighteenth modification of the embodiment.
Figure 25:
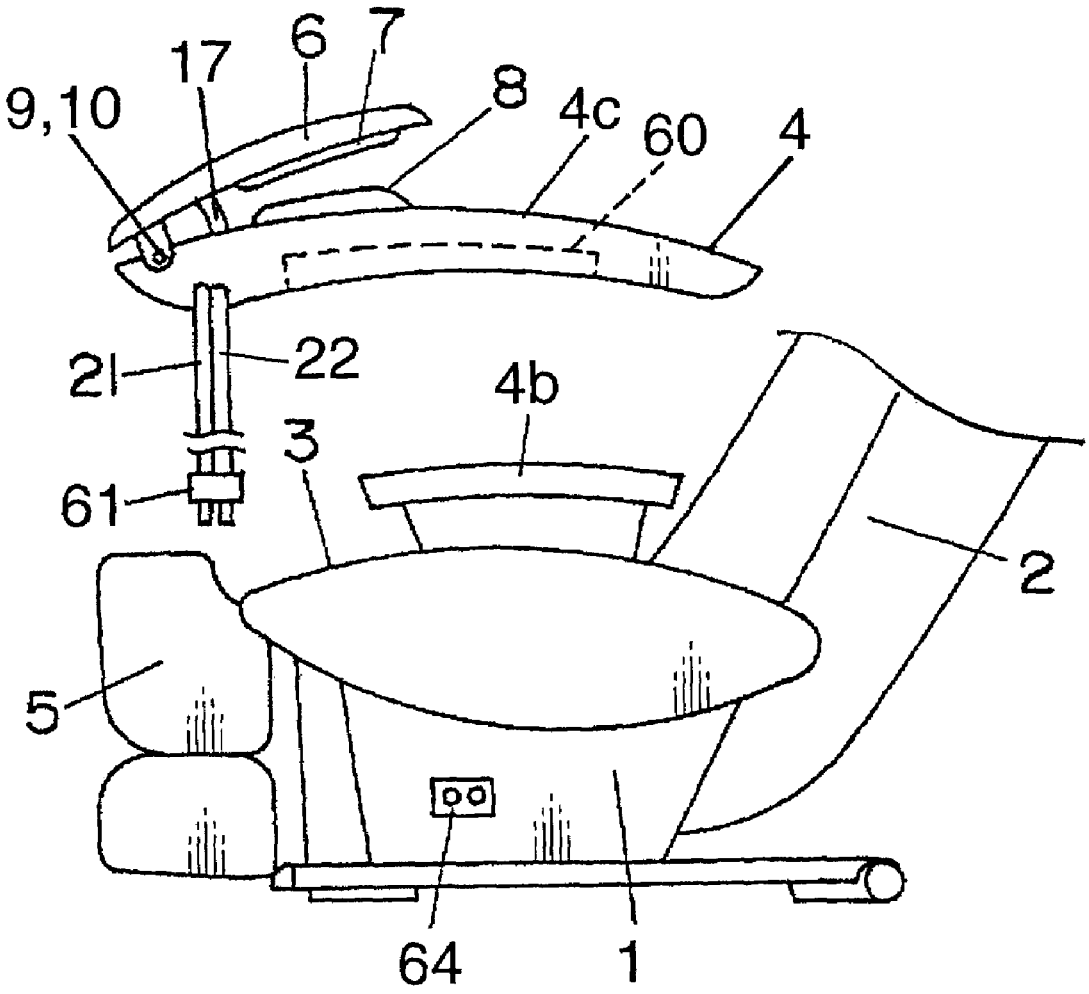
FIG. 25 is a side view of the massage chair with an upper armrest section shown in FIG. 24 detached.

In a massage chair meeting the above demand, the armrest 4 at each of the opposite left and right sides is comprised of a lower armrest section 4*b* fixed to the chair main body and an upper armrest section 4*c* detachably placeable on the lower armrest section 4*b* as shown in FIGS. 24 and 25. A recess 60 is formed in the lower surface of each upper armrest section 4*c*, and the lower armrest section 4*b* is fitted into the recess 60 when the upper armrest section 4*c* is placed on the lower armrest section 4*b*. The upper armrest section 4*c* may be fixed to the lower armrest section 4*b* by the lower armrest section 4*b* being fitted into the recess 60 when the upper armrest section 4*c* is placed on the lower armrest section 4*b* or may be fixed using screws or mechanical fasteners with the lower armrest section 4*b* fitted in the recess 60. A mechanical fastener is comprised of hook portions and loop portions paired with each other and, when the hook portions and the loop portions are strongly pressed against each other, they are so locked into each other as not to separate. When the hook portions and the loop portions are strongly pulled apart, they are disengaged. The mechanical fastener is also called surface fastener.

The covering member 6 which can be opened and closed by being rotated upward and downward is provided on the upper surface of each upper armrest section 4*c*. The massaging devices 7, 8 are provided on the lower surface of the covering member 6 and the upper surface of the upper armrest section 4*c*. In this embodiment, the massage members 7, 8 are expandable and shrinkable air bags, and a connector 61 is provided at ends of tube-like air supplying pipes 21, 22 for the upper armrest section 4*c* coupled to these air bags. In the chair main body is provided a connector 64 coupled to a source for supplying compressed air via air supplying pipes 62, 63 (see FIG. 30) for the chair main body. By connecting the connectors 61, 64, the air can be supplied to the air bags as the massaging members 7, 8. If the air supplying systems can be connected by the connectors 61, 64 in this way, the air supplying systems can be easily connected and detached even when the upper armrest sections 4*c* can be detachably placeable.

Figure 26:
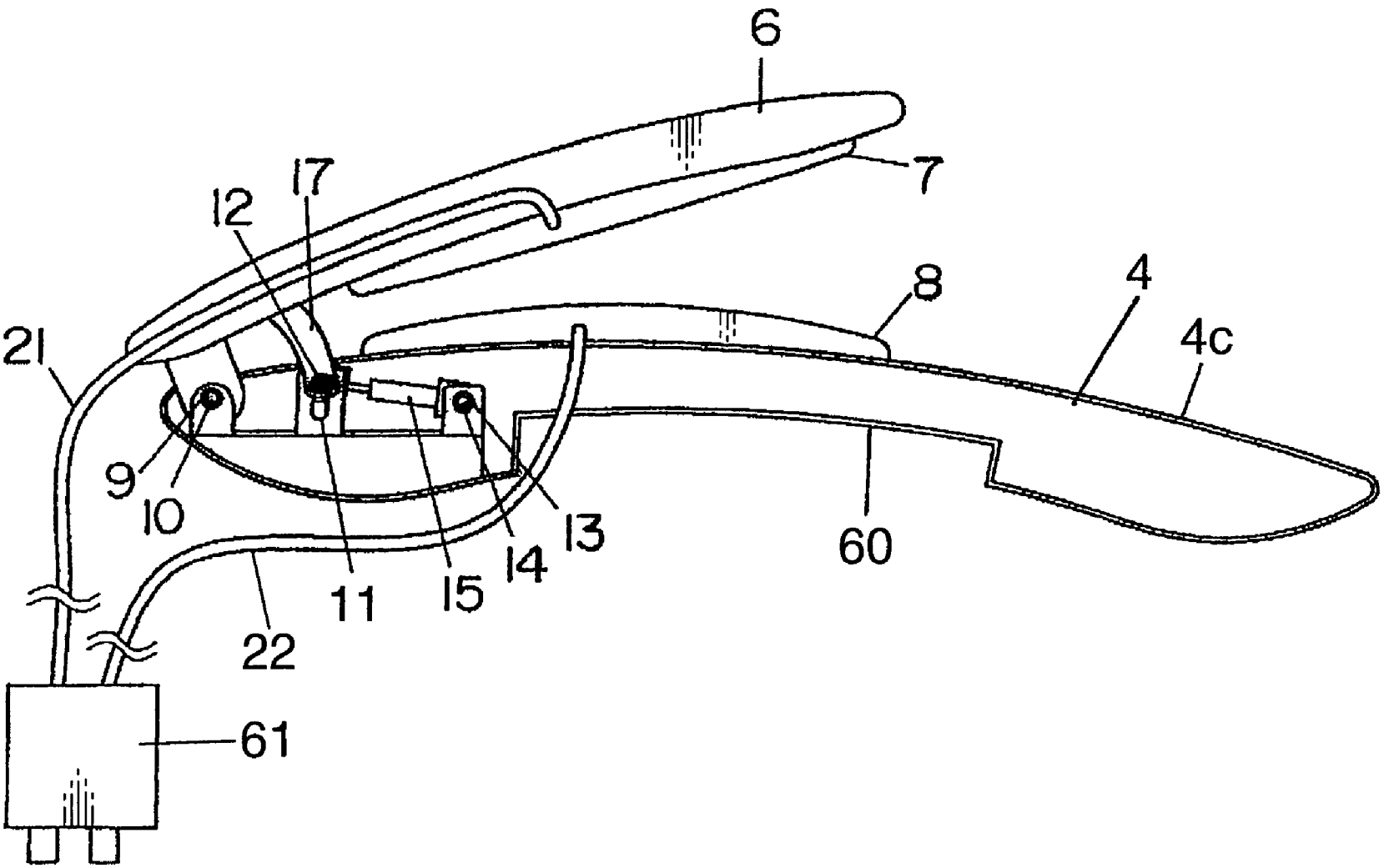
FIG. 26 is a side view partly in section showing the upper armrest section shown in FIG. 24 with a covering member opened.
Figure 27:
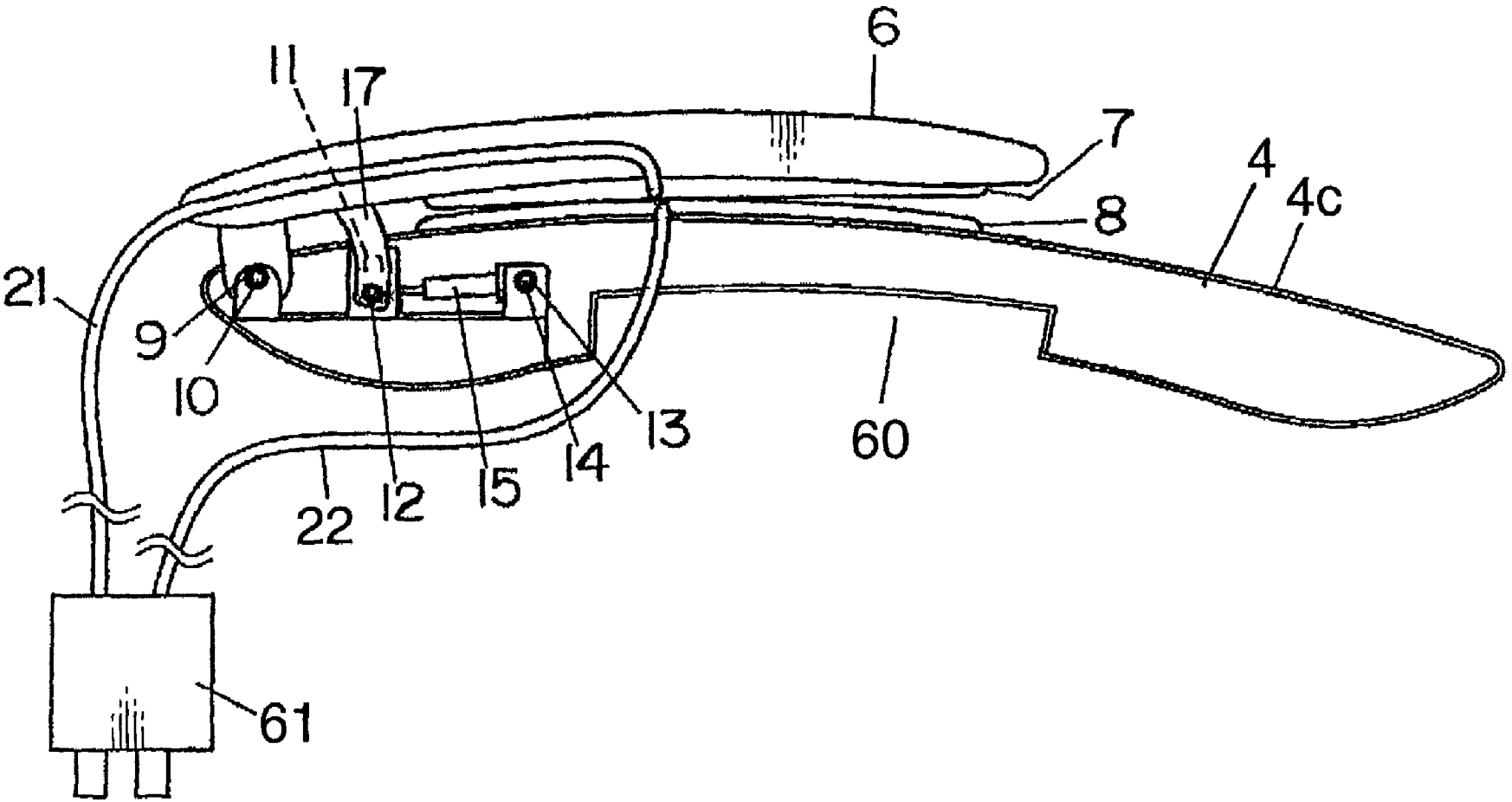
FIG. 27 is a side view partly in section showing the upper armrest section shown in FIG. 24 with the covering member closed.

If a user wants to have his hands and arms massaged while being seated in the chair 1 with the upper armrest sections 4*c* placed on the lower armrest sections 4*b*, he opens the covering members 6 as shown in FIG. 26, inserts his hands and arms between the covering members 6 and the upper armrest sections 4*c* to have them held between the covering members 6 and the upper armrest sections 4*c*, and drives the massaging devices 7, 8 to massage the hands and arms. The covering members 6 are closed as shown in FIG. 27 if the hands and arms are not temporarily massaged.

When the hands and arms are not massaged, the upper armrest sections 4*c* are detached from the lower armrest sections 4*b* and the connectors 61, 64 are disconnected from each other as shown in FIG. 25. By detaching the upper armrest sections 4*c* having the massaging devices 7, 8, the hands and arms can be placed on the lower armrest sections 4*b* when the hands and arms are not massaged, whereby the lower armrest sections 4*b* can be used as usual armrests. Then, the hand and arm resting positions are not restricted when the hands and arms are not massaged. Therefore, the user can relax without feeling tight.

Figure 28:
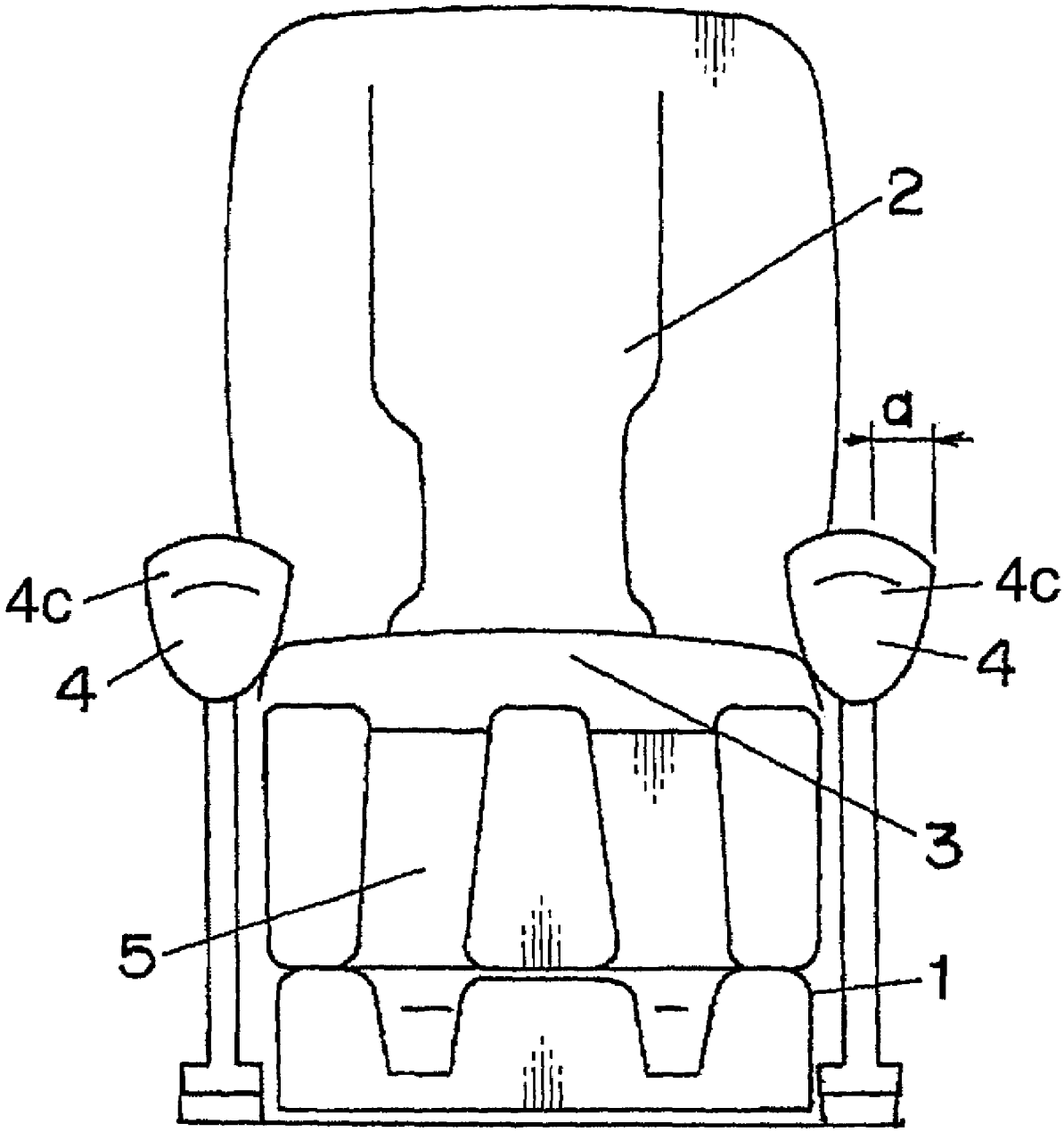
FIG. 28 is a front view of the massage chair shown in FIG. 24.

Further, since the upper armrest sections 4*c* are detachable, the chair 1 can be moved with the upper armrest sections 4*c* detached and the massage chair 1 can pass an opening of a room door or a corridor without being hindered by the upper armrest sections 4*c*. Thus, even the upper armrest sections 4*c* having a projecting distance "a" as shown in FIG. 28 does not cause any problem. Further, by forming the large upper armrest sections 4*c*, the hands and arms can be massaged in wider areas.

Figure 29:
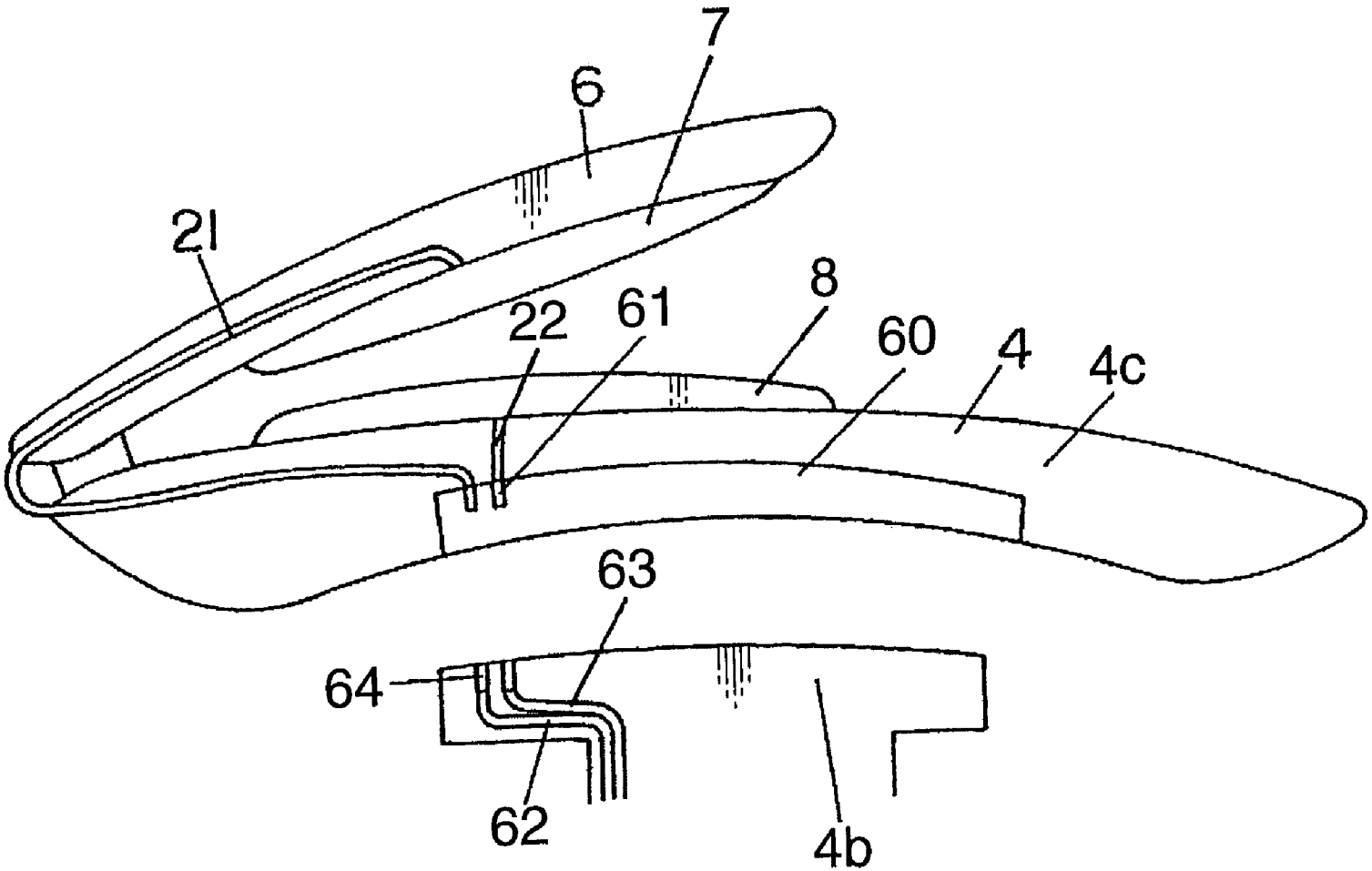
FIG. 29 is a side view partly in section showing an armrest section of a massage chair according to a nineteenth modification of the embodiment.
Figure 30:
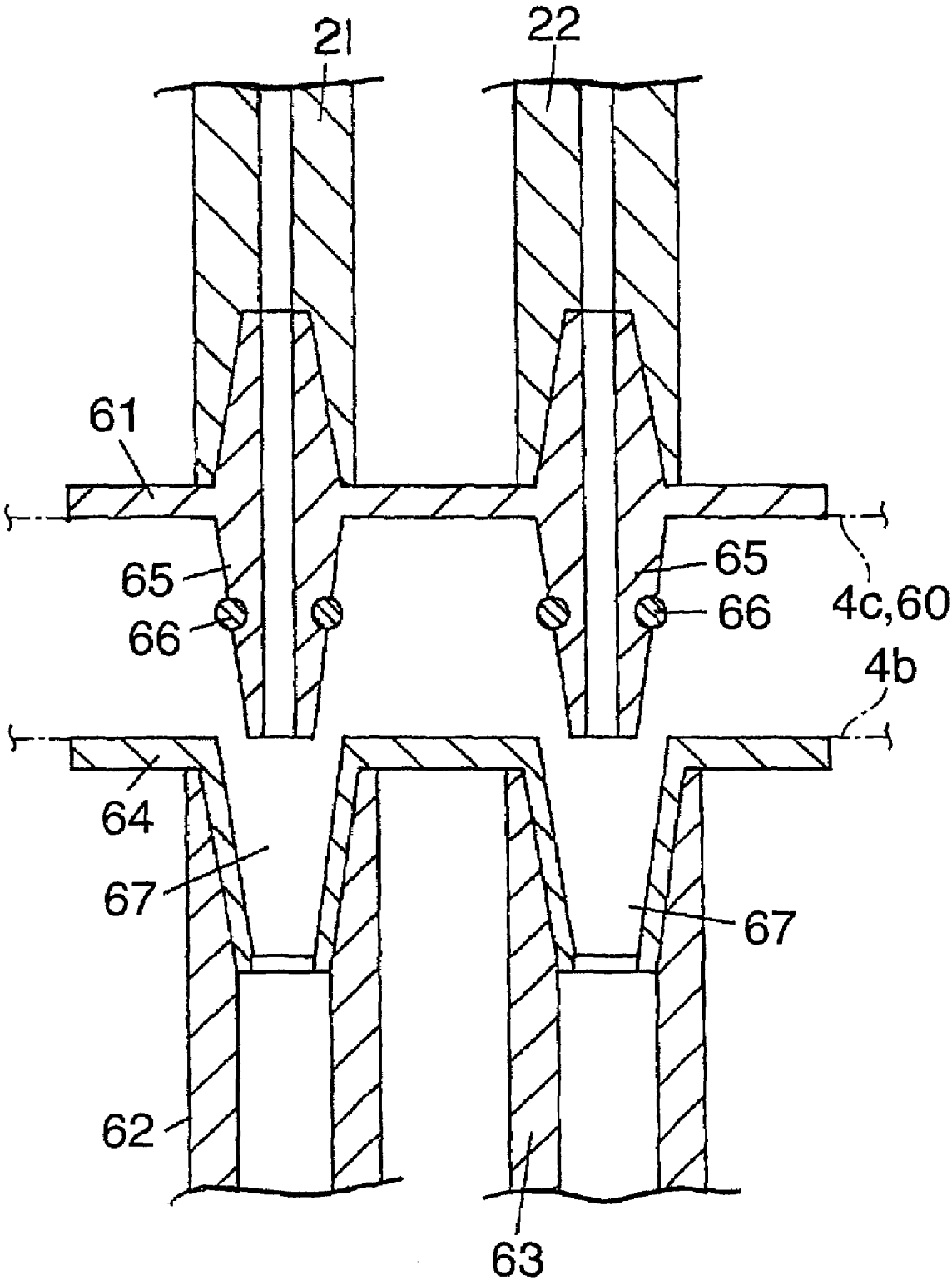
FIG. 30 is a sectional view showing connectors of the armrest section shown in FIG. 29.

In a nineteenth modification shown in FIGS. 29 and 30, the connectors 61 provided at the ends of the tube-shaped air supplying pipes 21, 22 for the upper armrest sections communicating with the air bags as the massaging devices 7, 8 are mounted in recesses 60 formed in the upper armrest sections 4*c*. Each connector 61 includes tubular insertable projections 65, and O-rings 66 are mounted on the outer circumferential surfaces of the insertable projections 65. Tube-shaped air supplying pipes 62, 63 for the chair main body communicating with the source for supplying the compressed air are installed in the chair main body, and the connector 64 provided at the ends of the air supplying pipes 62, 63 for the chair main body is mounted on the upper surface of each lower armrest section 4*b*. This connector 64 is formed with insertion recesses 67 into which the insertable projections 65 are insertable.

When the upper armrest section 4*c* is placed on the lower armrest section 4*b* to accommodate the lower armrest section 4*b* into the recess 60 of the upper armrest section 4*c*, the connectors 61, 64 are connected, whereby the insertable projections 65 are hermetically inserted into the insertion recesses 67 via the O-rings 66.

With this construction, the connectors 61, 64 are connected with each other only by placing the upper armrest section 4*c* on the lower armrest section 4*b*. This saves labor and time for connecting the connectors 61, 64 later on, and any body can connect the air supplying systems only by placing the upper armrest section 4*c*. Further, the connectors 61, 64 can be disconnected only by detaching the upper armrest section 4*c*. Further, since the air supplying pipes 62, 63 for the chair main body are accommodated in the chair main body, there is no likelihood that they are withdrawn or damaged by inadvertently getting caught by foot even if they take a tube-like shape.

Still another problem of the prior art is that both arms of a user are fixed while being massaged if they are massaged from above or from opposite lateral sides through the expansion and shrinkage of the air bags by means of the compressed air while being held on the armrests. Thus, when the user's physical condition suddenly goes bad or the massage chair experiences an abnormal operation, it is difficult to turn off the massage chair or for the user to move out of the massage chair.

Accordingly, there has been a demand for a massage chair designed to be easily turned off and to allow a user to easily move out at the time of an emergency such as an abnormal operation or a bad physical condition.

In order to realize such a massage chair, the above massage chairs (see FIGS. 1 to 23 and FIGS. 24 to 30) are constructed such that the compressed air can be supplied at different arbitrary timings to the massaging devices 7, 8 of the armrests 4 on the opposite left and right sides. The massaging devices 7, 8 of this embodiment include air bags for pressing a human body through the expansion thereof by means of the compressed air.

The left and right arms are inserted between the upper surfaces of the armrests 4 and the covering members 6 with the covering members 6 opened with respect to the armrests 4 at the left and right sides, and the compressed air is supplied to the air bags of the massaging devices 7, 8 to massage the arms by pressing forces. At this time, such a control as to change the pressing forces given to the respective arms is carried out so that either one of the arms can escape from the massaging devices (arm holding portions, arm massaging portions) 7, 8.

Figure 31:
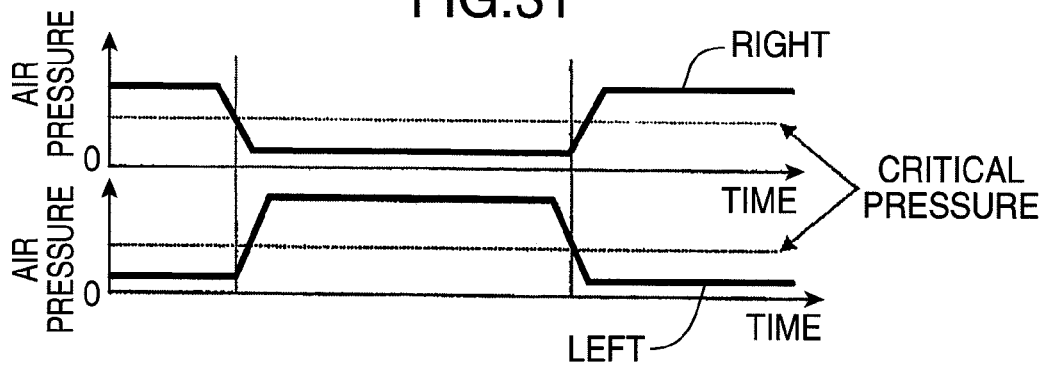
FIG. 31 is a timing chart showing a first operation of the massaging device.

In other words, the pressing forces are given to the arms by the air bags of the massaging devices 7, 8 of the armrests 4 at the left and right sides in accordance with a timing chart as shown in FIG. 31. In FIG. 31, horizontal axis represents time and vertical axis represents air pressure (force pressing the arm is equal to air pressure of the air bags), and the arms are massaged by alternately giving the pressing force to the armrests 4 at the left and right sides.

When it is assumed that an upper limit of the pressure at which the arm can easily escape from the massaging devices 7, 8 is called an arm escape enabling critical pressure (for example, 9807 Pa (0.1 $Kgf/cm^2$), a state where the pressing force is equal to or above the arm escape enabling critical pressure and a state where the pressing force is equal to or below the arm escape enabling critical pressure are repeated by the massaging devices 7, 8 at the left and right sides as shown in FIG. 31.

Phases of exerting the pressing pressure are reversed as described above in the armrests 4 at the left and right sides. In other words, while being given to one arm, the pressing force is not given to the other arm.

Thus, even if both arms are massaged while being placed on the armrests 4 at the left and right sides, only a pressure equal to or below the arm escape enabling critical pressure is given to either one of the arms. Therefore, at the time of a bad physical condition or an abnormal operation of the massage chair, the user can withdraw one arm to turn off the massage chair or move out of the massage chair.

Further, a device for measuring the pressure of the compressed air may be provided and the massage timing may be set such that, at a timing when the pressure of the arm bags at one side having stopped pressing the arm reaches the arm escape enabling critical pressure, the air bags at the other side start pressing the arm. Alternatively, a time lasting until the arm escape enabling critical pressure is reached after the air bags at one side stopped pressing the arm may be measured beforehand, and the air bags at the other side may start pressing the arm after the elapse of this time.

At the time of the massage in accordance with the timing chart of FIG. 31 as an operation example 1, it is also preferable to reduce the pressure given to the arm not being massaged to zero (0). In such a case, the arm can be more easily withdrawn since either one of the arms is not pressed at all.

Figure 32:
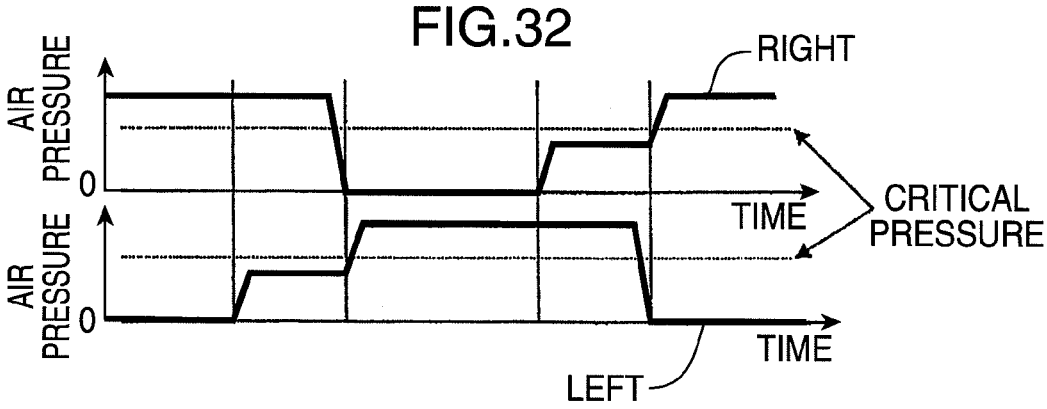
FIG. 32 is a timing chart showing a second operation of the massaging device.

At the time of a massage in accordance with a timing chart of FIG. 32 as an operation example 2, the pressing forces for massaging both arms repeat a cycle of zero pressure, middle pressure (slightly lower than the arm escape enabling critical pressure) and strong pressure (higher than the arm escape enabling critical pressure). While one arm is pressed with the strong pressing force, the middle pressing force or no pressing force is given to the other arm.

If the pressing force is changed in the cycle of zero, middle and strong pressures, the arms can be effectively massaged. Further, since the middle or zero pressure is given to the other arm while the one arm is pressed with the strong pressing force, the other arm can be easily withdrawn.

Figure 33:
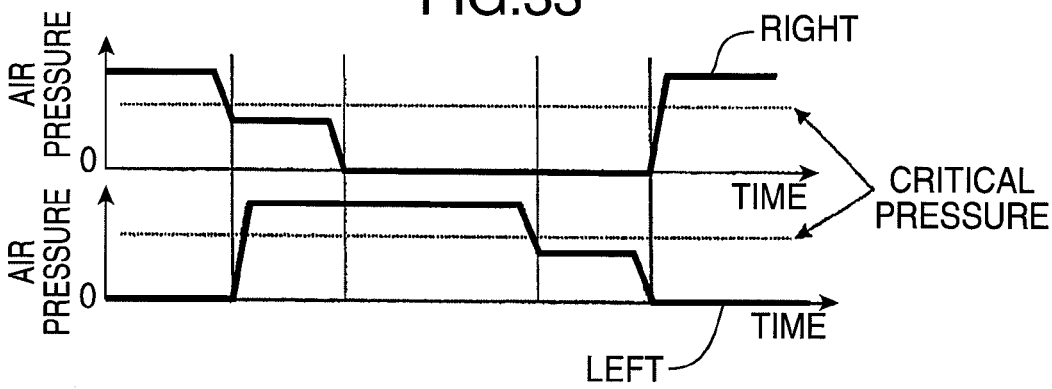
FIG. 33 is a timing chart showing a third operation of the massaging device.

At the time of a massage in accordance with a timing chart of FIG. 33 as an operation example 3, the pressing forces for massaging both arms repeat a cycle of zero pressure, strong pressure (higher than the arm escape enabling critical pressure) and middle pressure (lower than the arm escape enabling critical pressure). While one arm is pressed with the strong pressing force, the middle pressing force or no pressing force is given to the other arm.

If the pressing force is changed in the cycle of zero, strong and middle pressures, the arms can be effectively massaged. Further, since the middle or zero pressure is given to the other arm while the one arm is pressed with the strong pressing force, the other arm can be easily withdrawn.

Figure 34:
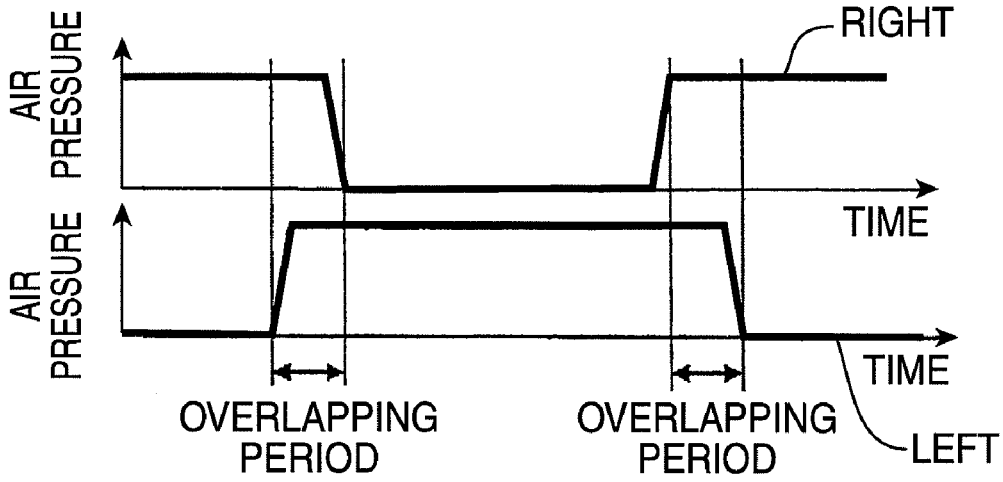
FIG. 34 is a timing chart showing a fourth operation of the massaging device.

At the time of a massage in accordance with a timing chart of FIG. 34 as an operation example 4, the pressing force given to the other arm is set to be equal to or below the arm escape enabling critical pressure while one arm is pressed at a pressure equal to or above the arm escape enabling critical pressure, but both arms are pressed at pressures equal to or above the arm escape enabling critical pressure only for a short overlapping period (e.g. 2 sec.).

Although both arms pressed at pressures equal to or above the arm escape enabling critical pressure, one arm can be withdrawn at a delayed timing since both arms are pressed at these pressures only for the short time. This can be realized only by controlling the pressing times without carrying out a control to keep the pressing forces equal to or below the arm escape enabling critical pressure for a specified time.

In this modification, upon massaging both arms, either one of the arms can be withdrawn by pressing one arm at a pressure equal to or above the arm escape enabling critical pressure while pressing the other arm at a pressure equal to or below the arm escape enabling critical pressure.

Figure 35:
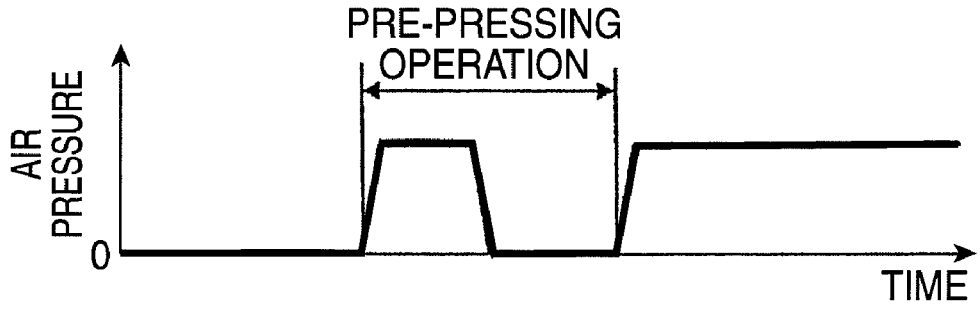
FIG. 35 is a timing chart showing a fifth operation of the massaging device.

When massaging both arms by pressing them, a massage may be given in accordance with a timing chart of FIG. 35 as an operation example 5. In other words, upon massaging the arm, the arm to be massaged is freed from the pressing after being once pressed (pre-pressing operation) and then pressed again to be massaged.

The first pressing has an effect of informing the user of the start of the massage and an effect of letting the user get used to the intensity of the massage. There is an additional effect of letting the user confirm the intensity of the massage by the first pressing and giving the user a chance to adjust the pressing force used for the massage, taking advantage of a period during the pressing is stopped.

Figure 36:
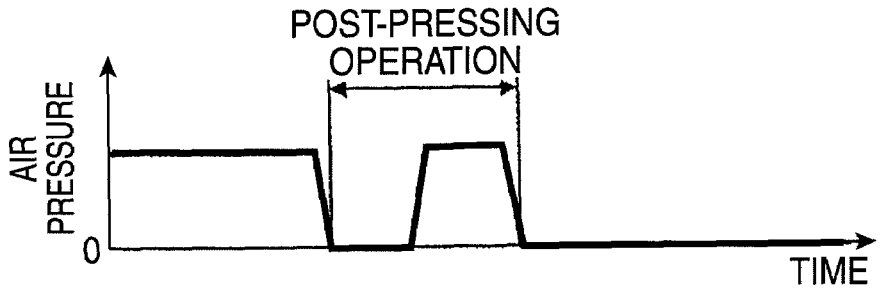
FIG. 36 is a timing chart showing a sixth operation of the massaging device.

Further, a massage may be given in accordance with a timing chart of FIG. 36 as an operation example 6. In this case, after one arm is massaged, the pressing is once stopped and then started and stopped again (post-pressing operation). This post-pressing operation has an effect of informing the user of the end of the massage and a cooling-down effect of the massage.

Figure 37:
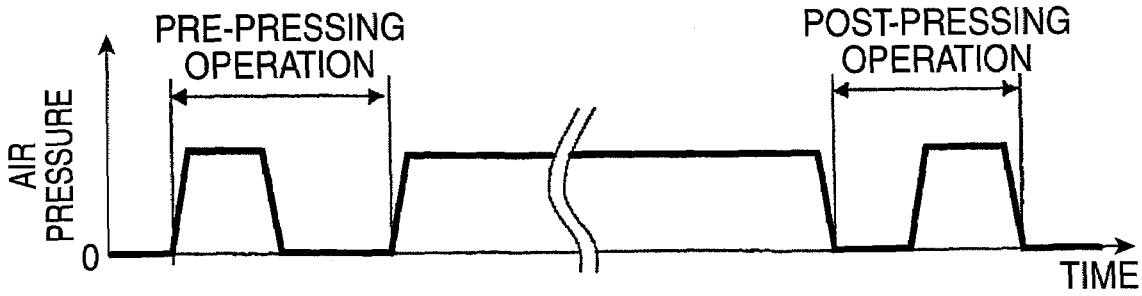
FIG. 37 is a timing chart showing a seventh operation of the massaging device.

Further, a massage may be given in accordance with a timing chart of FIG. 37 as an operation example 7. In this case, before and after one arm is massaged, the pre-pressing operation and the post-pressing operation are carried out.

The pressing force during the pre-pressing and post-pressing operations is preferably equal to or below the arm escape enabling critical pressure. In such a case, the user can easily withdraw his arms at a timing of simultaneously pressing the left and right arms.

The pressing periods of the pre-pressing and post-pressing operations are preferably short periods of time (e.g. about 2 sec. or shorter). In such a case, even if the user tries to withdraw his arms at a timing of simultaneously pressing the left and right arms, he can easily do so at a delayed timing.

It is also preferable to simultaneously carry out the pressing of the pre-pressing operation for one arm and the pressing of the post-pressing operation for the other arm. In such a case, since the arm to be massaged is switched after both arms are simultaneously pressed, the user can have the feeling of being continuously massaged.

In the case of simultaneously carrying out the pressing of the pre-pressing operation for one arm and the pressing of the post-pressing operation for the other arm in this way, at least one of them is preferably at a pressure equal to or below the arm escape enabling critical pressure.

The pre-pressing or post-pressing operations as above may be carried out a plurality of times.

It is also preferable that both arms are once pressed immediately after the stat of the arm massage, then the air is let out of the air bags pressing both arms to release the arm from the pressing and, thereafter, the massage is given as above.

By pressing both arms once immediately after the start of the massage, the user can recognize the massage pressure and change to his preferable massage intensity at an initial stage of the massage.

It is also preferable to repeat the massaging operation of a shorter time than a usual pressing time during a specified period after the start of the arm massage and the massage is given for the usual pressing time after the elapse of the specified period.

By repeating the massage of a shorter time than usual during the specified period, the user can more securely recognize the intensity of the pressing during the massage. Thus, the user can have a chance to securely change to a massage intensity suited to him at an early stage of the massage.

As described above, an inventive massage chair is provided with a seating surface, a backrest, and armrests at opposite left and right sides. Further, the massage chair comprises: a covering member provided on the upper surface of an armrest main body of each armrest and vertically displaceable to be opened and closed, and a massaging device provided on at least either one of the lower surface of each covering member and the upper surface of the corresponding armrest main body. The massaging devices are driven with hands and arms held between the lower surfaces of the covering members and the upper surfaces of the armrest main bodies. The upper surfaces of the covering members serve as arm resting surfaces with the covering members closed and the massaging device not driven.

The hands and arms can be massaged by being inserted between the covering members and the upper surfaces of the armrest main bodies after opening the covering members and by driving the massaging devices with the hands and arms held between the covering members and the upper surfaces of the armrest main bodies. When no massage is given by driving the massaging devices, the arms can be placed on the upper surfaces of the covering members as the arm resting surfaces by closing the covering members. Thus, a user can relax without feeling tight.

Preferably, the covering members may be held closed when the hands and arms are not massaged by driving the massaging devices.

Preferably, each covering member may be opened by being rotated upward about a supporting point located at a front side of the corresponding armrest main body.

Further preferably, each covering member may include a biasing member for biasing the covering member in opening and closing directions; the intensity of a biasing force of each biasing member changes depending on an opening position of the covering member; the force of the biasing member and the weight of the covering member balance out within an opening/closing range of the covering member; and an upward-acting force given by the biasing member is greater than the weight of the covering member if the covering member is located further along the opening direction than a balanced position while being smaller than the weight of the covering member if the covering member is located further along the closing direction than the balanced position.

Preferably, a fixing angle of each covering member upon opening the covering member may be adjustable.

Preferably, each massaging means may include a projected portion for point-pressing the hand or arm.

Preferably, each projected portion may be disposed at such a position as to press a Gokoku reflex point on the back of the hand.

Further preferably, each projected portion may include a positioning mechanism for bringing the projected portion into alignment with the Gokoku reflex point.

Preferably, a massage pressing the arm from opposite sides may be given by at least two massaging devices provided on the upper surface of each armrest main body and the lower surface of the corresponding covering member.

Preferably, the at least two massaging devices are located at the opposite sides of the centerline of each arm and sides of the massaging devices at the centerline are fixed.

Preferably, each massaging means may include a position adjusting device for preventing a displacement from a massaging position to the arm.

Further preferably, each armrest may include a lower armrest section fixedly provided on a chair main body and an upper armrest section detachably placeable on the lower armrest section, and the massaging device is provided on at least either one of the lower surface of each covering member and the upper surface of the corresponding upper armrest section.

Preferably, an air bag expandable and shrinkable by means of compressed air may be used as the massaging device provided on each upper armrest section, an end of each main-body side supplying pipe for supplying the air from the chair main body and an end of each armrest side air supplying pipe for supplying the air to the air bag of the upper armrest section are detachably connected by connecting connectors.

Preferably, the connector at the end of each main-body side supplying pipe is disposed on the upper surface of each lower armrest section, the connector at the end of each armrest side air supplying pipe is disposed on the lower surface of each upper armrest section, and the two connectors are connected with the upper armrest section placed on the lower armrest section.

Preferably, at the time of simultaneously massaging both arms by the massaging device of the armrests at the left and right sides, pressing forces given to both arms may be controllably changed such that the pressing force given to either one of the arms is of such a pressure as to enable the arm to escape from the massaging device.

Preferably, the pressing force of each massaging device pressing the arm repeats a cycle of zero, middle and strong pressures.

Further preferably, the pressing force of each massaging means pressing the arm repeats a cycle of zero, strong and middle pressures.

Preferably, after an arm is applied with pre-pressing, the arm being massaged may be once released and then pressed again.

Further, it may be preferable that after an arm is massaged by being, the pressing is once released and post-pressing is applied to the arm.

This application is based on patent application Nos. 2003-425046, 2003-425047, and 2003-425100 filed in Japan, the contents of which are hereby incorporated by references.

Although the present invention has been fully described by way of examples with reference to the accompanied drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A massage chair having a seating surface, a backrest, and armrests at opposite left and right sides, comprising:

a covering member provided on an upper surface of an armrest main body of each armrest and mounted for vertical displacement, to be opened and closed from said armrest main body; and a massaging device provided on at least either one of the lower surface of each covering member and the upper surface of each armrest main body, wherein:

the massaging device is configured to be driven with a user's hands and arms held between the lower surface of each covering member and the upper surface of each armrest main body; and an upper surface of each covering member is configured to serve as an arm resting surface when the covering member is closed.

2. A massage chair according to claim 1, wherein when each covering member is closed, the massaging device is not driven to massage the user'hands and arms.

3. A massage chair according to claim 1, wherein each covering member is opened by being rotated upward about a supporting point located at a front side of each armrest main body.

4. A massage chair according to claim 1, wherein:

each covering member includes a biasing member for biasing the covering member in opening and closing directions;

an intensity of a biasing force of each biasing member changes depending on an opening position of the covering member;

the force of the biasing member and the weight of the covering member balance each other within an opening/closing range of the covering member; and an upward-acting force provided by the biasing member is greater than the weight of the covering member when the covering member is located further along the opening direction than a balanced position, the upward-acting force is smaller than the weight of the covering member when the covering member is located further along the closing direction than the balanced position.

5. A massage chair according to claim 1, wherein the covering member has a fixing angle that is configured to adjustable open to conform to a thickness of the user's hands and arms.

6. A massage chair according to claim 1, wherein the massaging device includes a projected portion for point-pressing the user's hands or arms.

7. A massage chair according to claim 6, wherein the projected portion is positioned so as to point-press a Gokoku reflex point on a back side of the user's hand.

8. A massage chair according to claim 7, wherein the projected portion includes a positioning mechanism to bring the projected portion into alignment with the user's Gokoku reflex point.

9. A massage chair according to claim 1, wherein the massaging device comprises at least two massaging devices provided on at least one of the upper surface of each armrest main body and the lower surface of each corresponding covering member to massage and press the user's arms from opposite sides.

10. A massage chair according to claim 9, wherein the at least two massaging devices are located at the opposite sides of a centerline of the user's arms, and sides of the at least two massaging devices at the centerline are fixed.

11. A massage chair according to claim 10, wherein each of the at least two massaging devices includes a position adjusting device to prevent a displacement of the at least two massaging devices from a massaging position with respect to the user's arms.

12. A massage chair according to claim 1, wherein each armrest includes a lower armrest section fixedly provided on a chair main body and an upper armrest section detachably placeable on the lower armrest section, and the massaging device is provided on at least either one of the lower surface of each covering member and the upper surface of the corresponding upper armrest section.

13. A massage chair according to claim 12, wherein the massaging device comprises an air bag, expandable and shrinkable by compressed air, provided on each upper armrest section, and air is supplied to the air bag by air supplying pipes that extend from the chair main body to a side of each arm rest, wherein the air supplying pipes are detachably connected by connecting connectors.

14. A massage chair according to claim 13, wherein the connectors positioned at the end of each main body side supplying pipe are disposed on the upper surface of each lower armrest section, and the connectors at the end of each armrest side air supplying pipe are disposed on the lower surface of each upper armrest section, the connectors being connected when the upper armrest section is placed on the lower armrest section.

15. A massage chair according to claim 1, wherein, at a time of simultaneously massaging the user's arms by the massaging device of each of the armrests at the left and right sides, pressing forces acting on the user's hands and arms are controllably changed so as to allow the user's hands and arms to disengage from the massaging device.

16. A massage chair according to claim 15, wherein the pressing forces of the massaging device are configured to repeat a cycle of varying levels of pressure intensity.

17. A massage chair according to claim 15, wherein the pressing forces include an initial pre-pressing force to indicate the intensity of the pressing forces acting on the user's hands and arms.

18. A massage chair according to claim 15, wherein the pressing forces include a post-pressing force to indicate a stoppage of the pressing forces acting on the user's hands and arms.

* * * * *

UNITED STATES PATENT AND TRADEMARK OFFICE

CERTIFICATE OF CORRECTION

PATENT NO. : 7,381,194 B2
APPLICATION NO. : 11/014033
DATED : June 3, 2008
INVENTOR(S) : Yoda et al.

It is certified that error appears in the above-identified patent and that said Letters Patent is hereby corrected as shown below:

At column 17, line 21 (claim 2, line 3) of the printed patent, "user'" should be --user's--.

At column 17, line 45 (claim 5, line 3) of the printed patent, "adjustable" should be --adjustably--.

Signed and Sealed this

Thirteenth Day of January, 2009

JON W. DUDAS
*Director of the United States Patent and Trademark Office*